US007831374B2

(12) United States Patent
Sasaki et al.

(10) Patent No.: US 7,831,374 B2
(45) Date of Patent: Nov. 9, 2010

(54) COMBUSTION CONTROL SYSTEM FOR INTERNAL COMBUSTION ENGINE WITH RICH AND LEAN OPERATING CONDITIONS

(75) Inventors: Shizuo Sasaki, San Antonio, TX (US); Gary D. Neely, Boerne, TX (US); Jayant V. Sarlashkar, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 216 days.

(21) Appl. No.: 12/134,598

(22) Filed: Jun. 6, 2008

(65) Prior Publication Data

US 2009/0306877 A1 Dec. 10, 2009

(51) Int. Cl.
*F02D 41/30* (2006.01)
*F02D 41/34* (2006.01)

(52) U.S. Cl. ..... 701/104; 701/105

(58) Field of Classification Search ..... 701/101–105, 701/108–111, 115; 123/295, 305, 406.23, 123/406.24, 406.44–406.48, 478, 480, 486, 123/674, 679, 698
See application file for complete search history.

(56) References Cited

U.S. PATENT DOCUMENTS

| | | | | |
|---|---|---|---|---|
| 6,273,056 | B1 * | 8/2001 | Shirakawa et al. | 123/305 |
| 6,360,159 | B1 * | 3/2002 | Miller et al. | 701/103 |
| 6,508,241 | B2 * | 1/2003 | Miller et al. | 123/672 |
| 6,612,292 | B2 * | 9/2003 | Shirakawa | 123/501 |
| 7,093,568 | B2 * | 8/2006 | Yang | 123/27 R |
| 7,163,007 | B2 * | 1/2007 | Sasaki et al. | 123/673 |
| 7,206,688 | B2 | 4/2007 | Wang et al. | |
| 7,389,173 | B1 | 6/2008 | Wang | |
| 7,398,149 | B2 * | 7/2008 | Ueno et al. | 701/108 |
| 7,562,649 | B2 | 7/2009 | Sarlashkar et al. | |
| 7,565,237 | B2 | 7/2009 | Wang | |
| 2007/0174003 | A1 * | 7/2007 | Ueno et al. | 701/104 |

* cited by examiner

*Primary Examiner*—Stephen K Cronin
*Assistant Examiner*—Johnny H Hoang
(74) *Attorney, Agent, or Firm*—Ann C Livingston

(57) ABSTRACT

A method of controlling combustion of an internal combustion engine that use fuel injection and that uses lean and rich modes of operation. Combustion control values, such as for fuel injection timing and quantity are determined by a torque representative value. This value is obtained from estimated in-cylinder conditions and from engine speed.

17 Claims, 19 Drawing Sheets

COMBUSTION CONTROL SYSTEM FOR INTERNAL COMBUSTION ENGINE WITH RICH AND LEAN OPERATING CONDITIONS

TECHNICAL FIELD OF THE INVENTION

This invention relates to engine control systems, and more particularly to an engine control system that controls fuel injection (for direct injection engines) or spark timing (for spark ignited engines).

BACKGROUND OF THE INVENTION

Today's conventional control systems for diesel engines (or other internal combustion engines that use direct fuel injection) are "fuel-based". In response to activity of the accelerator pedal, an engine control unit determines the quantity of fuel to inject. Downward action of the accelerator pedal causes the engine control unit to inject more fuel.

Typical fuel-based engine control calibrations utilize high excess air ratios which do not result in combustion that is sensitive to variations in in-cylinder conditions. In particular, the combustion is not sensitive to airflow mass, air fuel ratio, or exhaust gas recirculation (EGR) rate. For some modern diesel engines, fuel injection is adjusted based on airflow mass measurement to control soot in small regions of the operating range, but this control method is still primarily fuel-based.

U.S. Pat. No. 7,163,007 describes an "oxygen-based" combustion control system. For both lean and rich operating conditions, an estimated in-cylinder oxygen amount (oxygen mass) is used to determine fueling parameters. For transient operating conditions (rich-to-lean or lean-to-rich), in addition to current oxygen mass, an oxygen mass ratio between lean and rich is used to determine the fueling parameters.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

1. Overview

The following description is directed to engine control methods suitable for use with an internal combustion engine that operates with both lean and rich combustion modes. Examples of such engines may include both diesel engines and stratified charge engines (both gasoline and diesel).

These engines must be capable of smooth and efficient switching between the rich and lean modes. For example, these types of engines may be used with emissions after treatment devices (such as lean Nox traps) that require switching from lean to rich mode during periodic regeneration and then back to lean mode.

The combustion control parameters for these engines may include fueling parameters (such as for direct diesel fuel injection into the cylinder) and/or ignition timing parameters (such as for spark ignition of an air-gasoline mixture). Fueling parameters may include injection quantity, pressure, number of injections, and injection timing. The concepts described herein are applicable regardless of whether the engine is direct injection or spark ignited; the term "combustion control parameters" is used herein to include either fueling or spark timing parameters for any type of fuel injection engine.

As explained below, one feature of the invention is that combustion control parameters are determined by various factors, one of which is a "torque representative factor" referred to herein as "k". Despite the operating mode (lean, rich, or transient), a desired relation between k and torque is maintained.

For purposes of this description, the following engine control modes are recognized:

| | |
|---|---|
| Mode 0 | idle |
| Mode 1 | negative engine torque |
| Mode 2 | lean |
| Mode 3 | rich |
| Mode 23 | transient lean to rich |
| Mode 32 | transient rich to lean |

Figure 1:
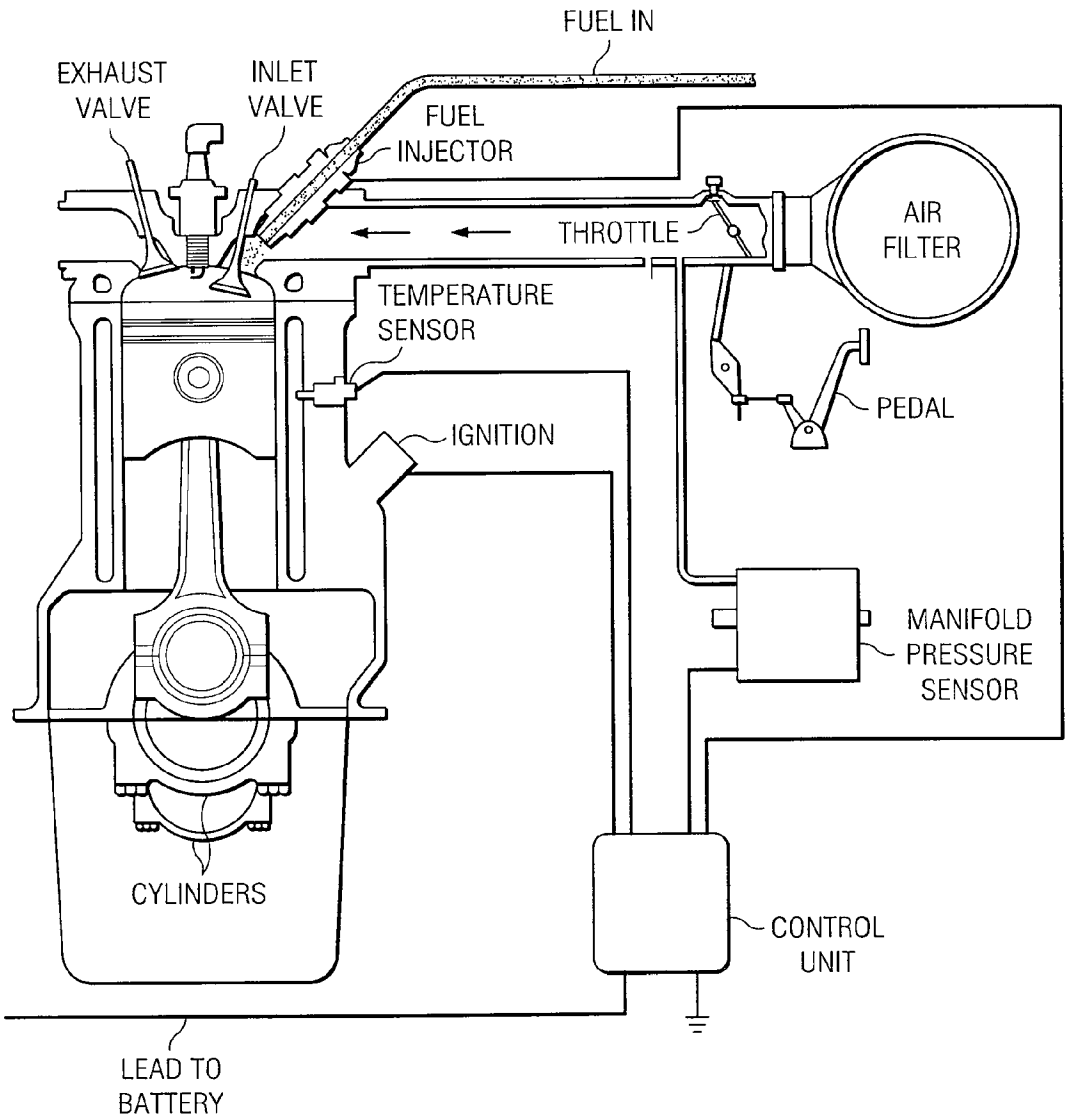
FIG. 1 illustrates an example of an engine having fuel injection and capable of operating in lean and rich modes, and having a control unit that operates in accordance with the methods described herein.

FIG. 1 illustrates a typical internal combustion engine with fuel injection, of a type with which the methods described herein may be used. In the example of FIG. 1, engine 100 is a gasoline engine. A stratified charge engine is one example of a gasoline engine that has lean and rich modes and that uses fuel injection. As indicated above, diesel engines also meet these criteria.

Various elements of engine 100 are known. Engine 100 is assumed to have an EGR (exhaust gas recirculation) loop, as well as various air handling devices. Air-handling actuators include valve(s) for EGR, SCV (swirl control valve), and VNT (variable nozzle turbo) actuators, and the like.

Engine 100 has a fuel injector and other fueling actuators. It further has appropriate sensors for acquiring various input values relevant to the methods described herein, such as those described below in connections with FIGS. 14, 27, 28, and 29. These sensors include sensors for measuring intake air temperature, pedal position, coolant temperature, engine speed, exhaust gas oxygen, intake air flow, exhaust air flow, etc.

Of particular relevance to the present invention is a combustion control unit 10, programmed to control various combustion control parameters in accordance with the methods described herein. Control unit 10 may be a processor-based unit having appropriate processing and memory devices. The memory of control unit 10 also stores various tables, which store maps of known values to variables. Values for these tables are acquired as described below, and then stored in control unit 10 for access during engine operation. Control unit 10 may be integrated with or part of a comprehensive engine control unit.

Figure 2:
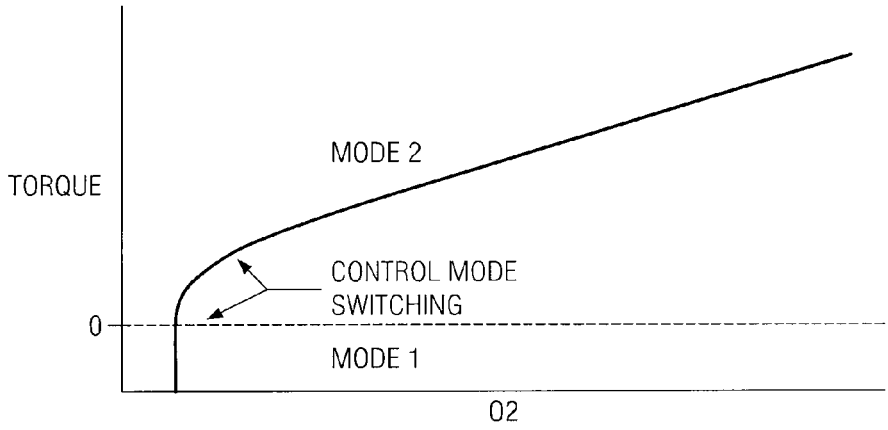
FIG. 2 illustrates the relationship between engine torque and in-cylinder oxygen mass for optimal combustion in Modes 1 and 2.

FIG. 2 illustrates the relationship between torque and total in-cylinder oxygen (O2) mass for optimal combustion in Modes 1 and 2. Engine torque increases with increasing O2 for most of the engine operating region. However, in Mode 1, O2 must increase while the engine torque decreases. This is necessary to maintain combustion stability. As a result, there can be two suitable torque points for a given O2 content. To avoid this situation, mode switching control methods have been developed that use only monotonic sections of the O2-torque relation.

More specifically, in Mode 0 the pedal position is 0 and torque is controlled by engine speed. As explained below, Mode 1 can be controlled using the same control method as Mode 2. Mode 0 and Mode 2 are connected directly. Torque passes smoothly between these two modes depending on smooth sweeping of a representative O2 value, referred to herein as $O2_a$*.

In Modes 2 and 3, combustion control methods are airflow-based. Airflow mass predicts torque (a representative value). More specifically, a torque representative factor, k, is selected based on predicted in-cylinder conditions (a temperature representative value and an O2 representative value) and engine speed (rpm).

Then, for Modes 2 and 3, the values of k and rpm determine the combustion control parameters. Fuel injection quantity and rail pressure are directly controlled by k and engine speed. Fuel injection timing (and ignition timing, in the case of a gasoline engine) are also decided by k and engine speed, but corrected by O2 concentration. Air-handling actuators are controlled by desired torque.

Mode 3, such as for LNT regeneration, starts at a point when O2 mass arrives at the desired O2 mass for rich combustion at the desired torque. To keep suitable rich operation, air handling actuator positions are decided from current actuator positions and a differential of pedal position. In Mode 3, the fuel injection quantity is corrected, using exhaust sensor feedback, to obtain a desired air fuel ratio.

During Modes 23 and 32, combustion control parameters are based on desired torque and in-cylinder conditions. Desired torque (representative) is defined from previous torque, the differential of pedal position, and engine speed. Fuel injection is controlled to adjust to torque under the in-cylinder condition. Empirical functions are used to define fuel injection quantity to keep the same torque under varying O2 mass from rich to lean condition. In the empirical functions, fuel injection mass is calculated from rich and lean fuel mass, which are defined from torque representative, ambient temperature and engine speed, and current O2 mass. Empirical functions are also used to define fuel injection timing at steady state condition to keep optimal combustion under varying O2 mass from rich to lean condition. To compensate the bias of O2 concentration at transient, an empirical function to correct injection timing is used.

2. Airflow-Based Control System for Mode 2

At a steady state engine operating condition, the torque representative, k, is decided by the following factors: representative O2 mass in fresh air, an in-cylinder temperature representative, and engine speed.

The in-cylinder O2 mass is the sum of the O2 mass in fresh air and O2 mass in EGR gas. However, in steady state conditions, the ratio of O2 in fresh air and EGR gas is constant at each operation point. Therefore, in steady state, O2 in fresh air, which increases monotonically with increasing torque, can be used to determine the value of the torque representative, k.

In transient conditions, the O2 mass in EGR deviates from that of steady state condition. To compensate for this effect, a "fake" (also referred to herein as a "representative") value for O2 mass in fresh air, O2a*, is introduced. The ratio between fake and real O2 mass in fresh air is proportional to the transient and steady state in-cylinder O2 mass ratio. The value of the fake O2 mass increases monotonically with increasing pedal position.

In addition, a weighting factor, determined as a function of air flow mass, f(Ga), is introduced and multiplied to the deviated O2 mass in EGR from steady state. In most operating conditions, f(Ga)=1, which does not affect the value of (O2a*). However, at very light load, f(Ga)<1. Using this weighting factor, in-cylinder O2 mass is calculated and fake O2 in fresh air, O2a*, is recalculated. As a result, the torque representative, k, is reduced monotonically with decreasing O2a* including during special operations such as after a fuel cut. Fuel injection mass is decided by the torque representative value, k, and engine speed. Combustion timing (fuel injection or ignition) is decided by the torque representative, engine speed, and in-cylinder O2 concentration.

2.1 Representative in-Cylinder O2 Mass, O2a*

Figure 3:
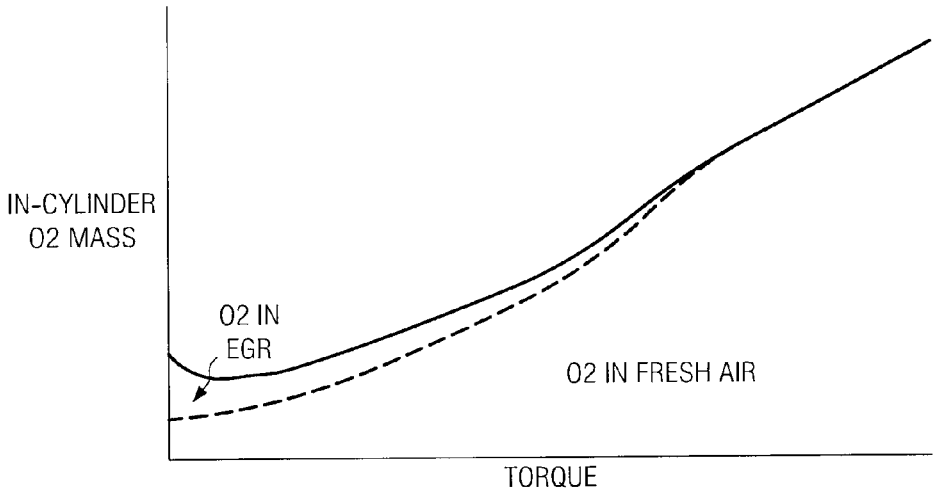
FIG. 3 illustrates the relationships between engine torque and in-cylinder oxygen mass from EGR and from fresh air.

FIG. 3 illustrates the relationship between torque and in-cylinder O2 mass from both fresh air intake and EGR gas. To optimize combustion, the torque representative, k, should be related to the in-cylinder O2 mass. However, as illustrated, the total in-cylinder O2 mass does not change monotonically with torque. However, O2 in fresh air does change monotonically with torque. If fresh air O2 can be used to determine k, Mode 1 can be removed, making the control algorithm much simpler.

More specifically, at steady state, in-cylinder O2 mass ($O2_{total\text{-}ss}$) is the total of O2 in fresh air ($O2_{a\text{-}ss}$) and O2 in EGR ($O2_{E\text{-}ss}$). Expressed mathematically:

$$\begin{aligned} O2_{total-ss} &= (O2_{a-ss}) + (O2_{E-ss}) \\ &= O2_{a-ss}\{(O2_{a-ss} + O2_{E-ss})/O2_{a-ss}\} \\ &= O2_{a-ss}/C_0, \end{aligned}$$

where $C_0$ is a "fresh O2 ratio" and $C_0 = O2_{a\text{-}ss}/(O2_{a\text{-}ss} + O2_{E\text{-}ss})$.

In other words, $O2_{total\text{-}ss}$ is determined from $O2_{a\text{-}ss}$ and $C_0$. The value of $C_O$ is determined by fresh airflow mass (Ga), temperature (T*), and engine speed (rpm) at steady state, and is less than 1. That is, $C_0$(Ga, T*, rpm)≦1.

At transient, in-cylinder O2 mass is, $$\begin{aligned} O2_{total} &= (O2_a) + (O2_E) \\ &= O2_a/C_0 + \Delta O2_E, \end{aligned}$$

where $\Delta O2_E$ is the deviation of O2 mass in EGR gas from steady state, $$= O2_a(1/C_0 + \Delta O2_E/O2_a)$$

When fake O2 mass in fresh air ($O2_a$*) is assumed, $$O2_{total} = O2_a(1/C_0 + \Delta O2_E/O2_a) = O2_a^*/C_0\ O2_a^* = O2_a + C_0\Delta O2_E$$

Thus, in the above-described manner, O2a* is calculated from the in-cylinder fresh air mass (O2a), the fresh O2 ratio ($C_0$=(O2 in fresh air)/(in-cylinder O2)) at steady state condition, and the deviation of O2 mass in EGR at transient from steady state ($\Delta O2_E$). Various estimation methods can be used to estimate $O2_a$, such as the method based on air flow referenced in the Background.

Generally, the relation between O2a* and the accelerator pedal position is monotonical. However, in a special case, such as after a fuel cut, $\Delta O2_E$ becomes very big and O2a* becomes higher at lower pedal position. To avoid this problem, a fresh air flow weighting function, f(Ga), is introduced. This function is used to scale the value of $\Delta O2_E$. The value of O2a*is manipulated with f(Ga) as follows:

$$O2_a^* = O2_a + f(Ga) \cdot C_0\Delta O2_E$$

Figure 4:
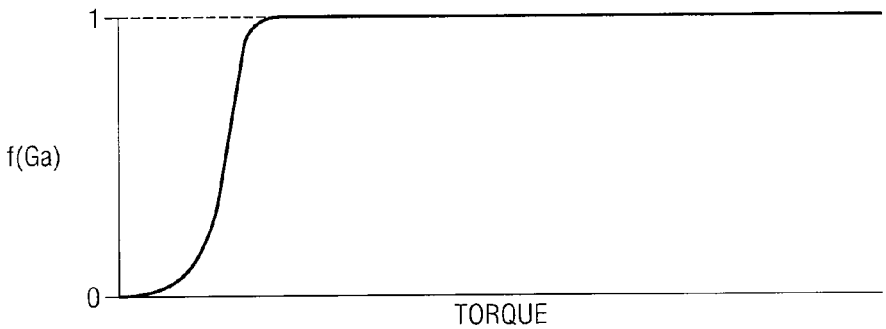
FIG. 4 illustrates a fresh air flow function used to determine a representative value for in-cylinder oxygen mass.

FIG. 4 illustrates f(Ga) as a function of torque. The value of f(Ga) changes from 0 to 1, and for most of engine operation, f(Ga)=1. However, at light load, where air fuel ratio is high enough and combustion is robust and not affected so much by in-cylinder condition, f(Ga) changes from 1 to 0. The manipulation of O2a*by f(Ga) at light load realizes the desired monotonic relation between O2a* and pedal position.

2.2 Temperature Representative Factor, T*

Temperature, T*, is a second important factor of the in-cylinder condition. The value T* includes the effect of coolant temperature($T_{cool}$) and intake temperature($T_{in}$).

$$T^* = T_{cool} + f_T(T_{in} - T_{in\text{-}ss})$$

2.3 Calculation of O2a*

Figure 5:
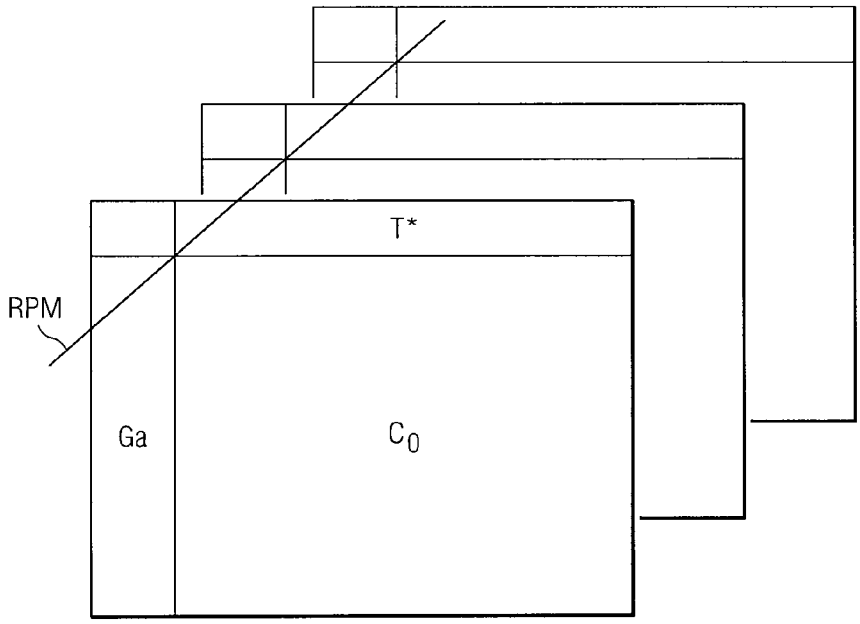
FIG. 5 illustrates Mode 2 tables that map fresh air flow weighting values, temperature representative values, and engine speed to fresh air ratio values.
Figure 6:
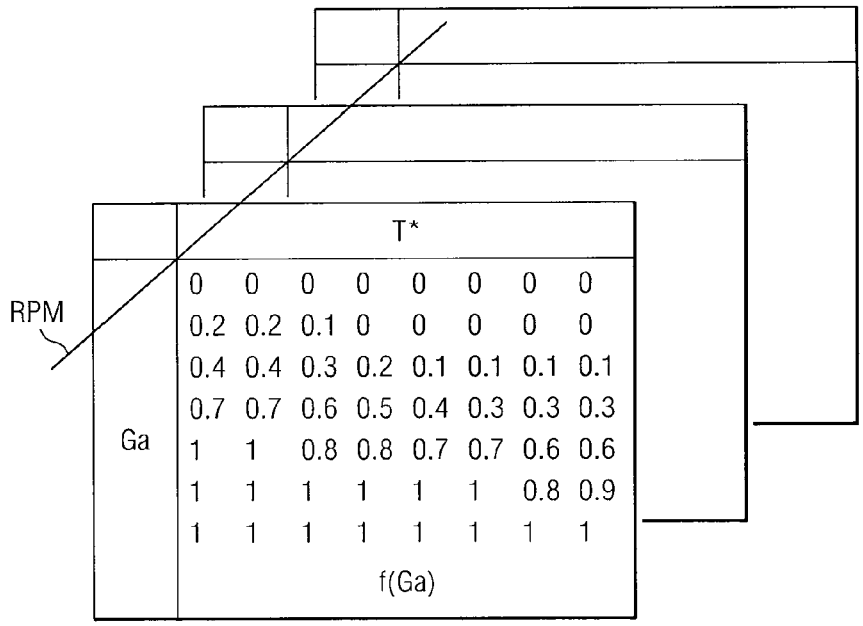
FIG. 6 illustrates Mode 2 tables that map fresh air function values, temperature representative values, and engine speed to fresh air flow weighting values.
Figure 7:
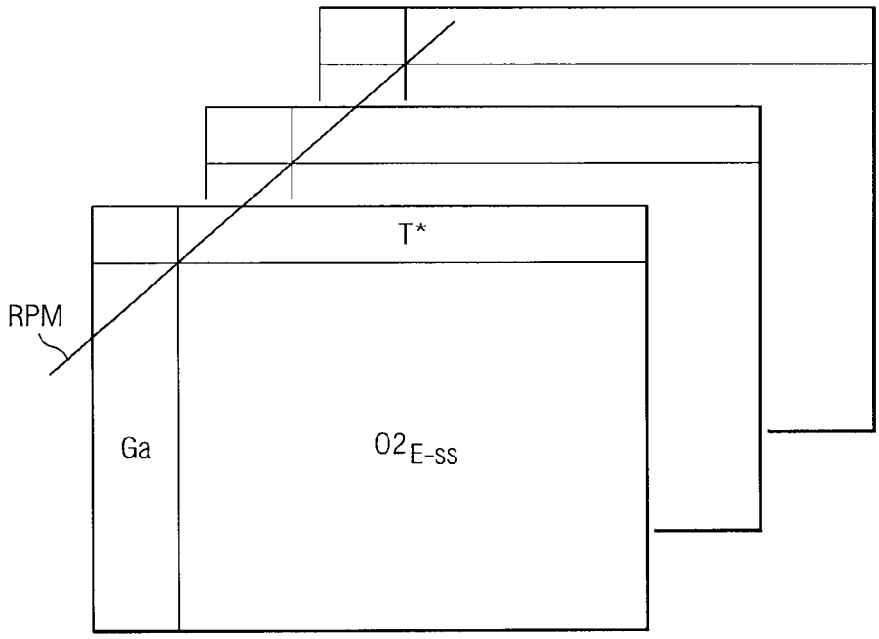
FIG. 7 illustrates Mode 2 tables that map fresh air flow weighting values, temperature representative values, and engine speed to steady-state oxygen EGR values.

FIGS. 5, 6 and 7 illustrate how $C_0$, f(Ga) and $O2_{E\text{-}ss}$ are mapped to T* and Ga. Different calculations are made for different engine speeds (rpm). From these maps, values of O2a* can be calculated, using the above-described mathematical calculations.

2.4 Torque Representative Factor, k

Figure 8:
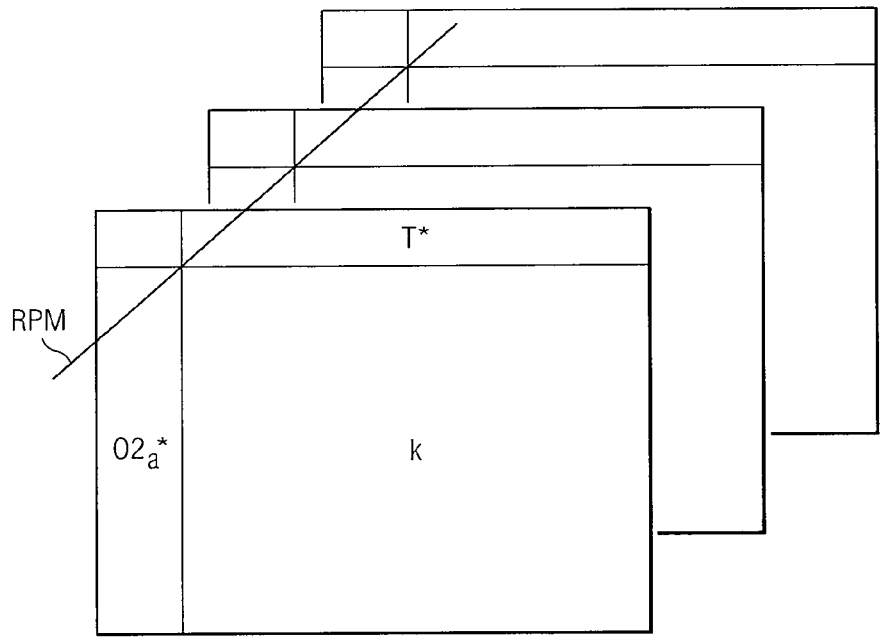
FIG. 8 illustrates Mode 2 tables that map fresh air representative values, temperature representative values, and engine speed values to torque representative values.

FIG. 8 illustrates how the torque representative factor, k, is determined from O2a*, T* and engine speed. The value of k increases with increasing O2a* monotonically.

As stated above, each value of k determines associated fueling parameters. These fueling parameters include:

Qf injection quantity (main, pilot, etc.)

θ injection timing (main, pilot, etc.)

$P_{rail}$ rail pressure

Fueling parameters are decided in steady state testing. Once k is determined, tables are created to map k and T* to fueling parameters for varying rpm.

Figure 9:
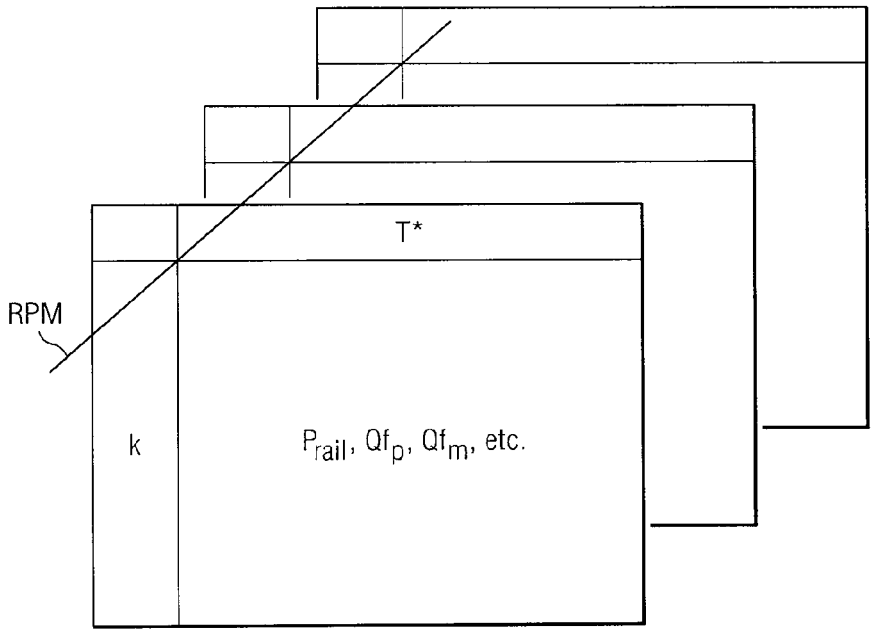
FIG. 9 illustrates Mode 2 tables that map torque representative values, temperature representative values, and engine speed values to fueling parameter values.

FIG. 9 illustrates how tables may be used to store values of fuel injection quantity and rail pressure, as mapped from (decided from) k, T*, and rpm. Fueling parameters for main versus pilot injection are distinguished by subscripts, m, p, etc. Thus, these parameters are determined directly from steady state maps.

Figure 10:
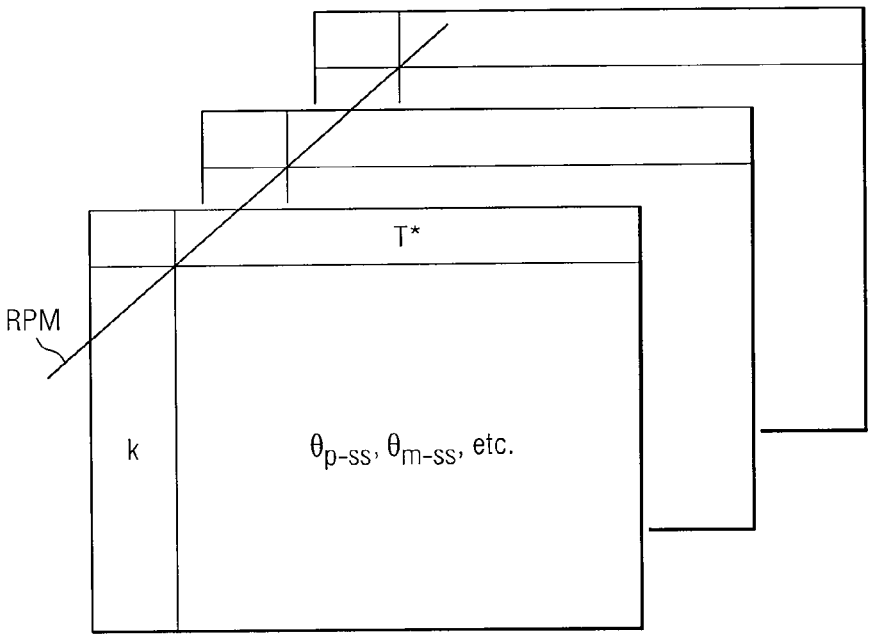
FIG. 10 illustrates Mode 2 tables that map torque representative values, temperature representative values, and engine speed values to fueling timing parameter values.

FIG. 10 illustrates a table of fuel injection timing, also mapped from k, T*, and rpm. Steady state conditions are indicated by the additional subscript, -ss. As explain below, the injection timing parameter is corrected by O2 concentration.

2.5 Fuel Injection Timing Correction by O2 Concentration

Combustion characteristics, such as fuel consumption, combustion noise, stability, smoke, and engine out NOx, are significantly affected by both injection timing and the air-fuel ratio (namely EGR rate or O2 concentration at the same injection quantity).

The O2 concentration at steady state is denoted by $O2_{c\text{-}ss}$. When this value is lower at the same k and rpm, injection timing should be advanced. This injection timing advancement is denoted by Δθ (main or pilot), where:

$$\Delta\theta_{p,\,m,\,etc.}=\theta_{p,\,m,\,etc.}-\theta_{p\text{-}ss,\,m\text{-}ss,\,etc.\text{-}ss}$$

Figure 11:
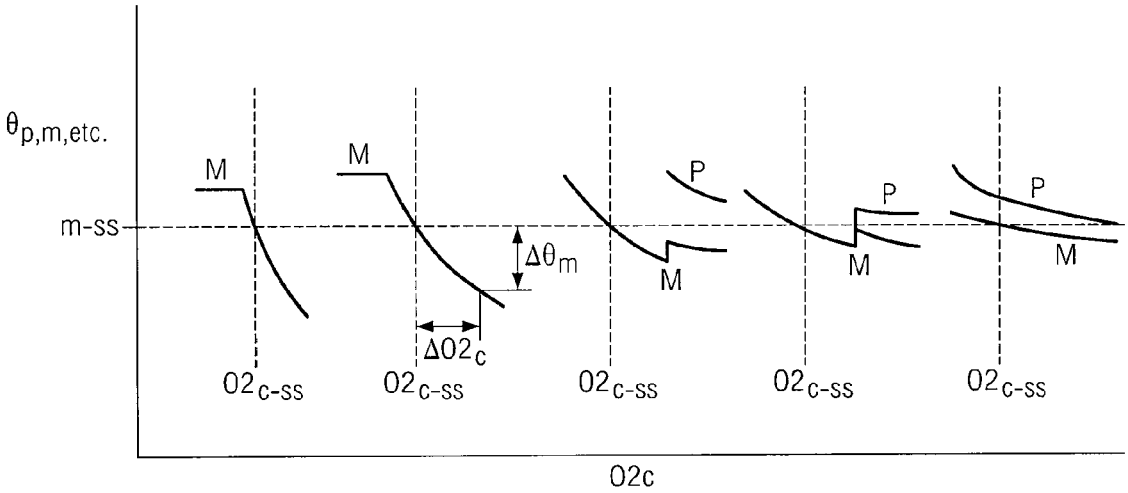
FIG. 11 illustrates the optimal relationship between oxygen concentration at steady state and injection timing.

FIG. 11 illustrates the optimal relation between $O2_{c\text{-}ss}$ and injection timing. When the O2 concentration at steady state is lower (except at very low load where f(Ga)<1), the injection timing advancement should be bigger for the same $\Delta O2_c$ (the bias of O2 concentration at transient from steady state).

Figure 12:
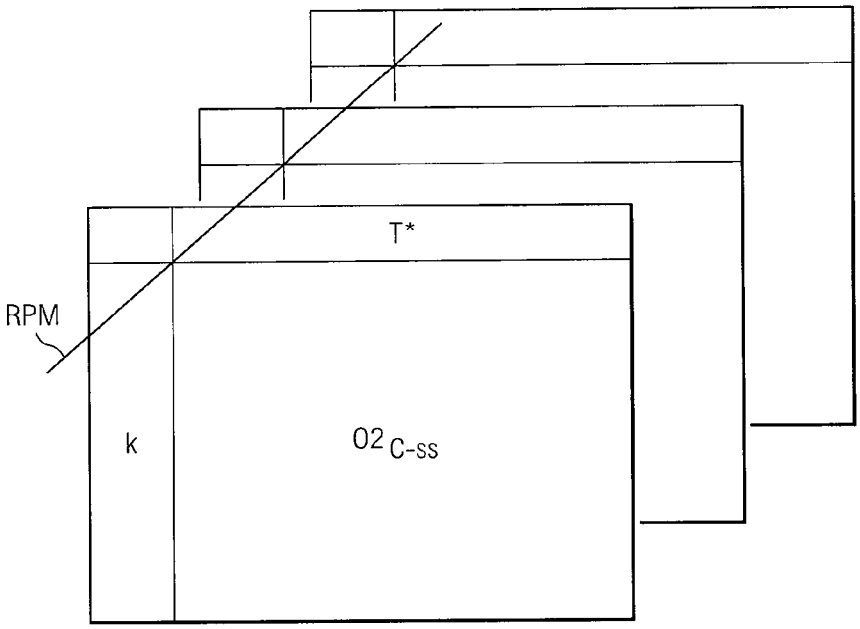
FIG. 12 illustrates Mode 2 tables that map torque representative values, temperature representative values, and engine speed values to the oxygen concentration at steady state.

FIG. 12 illustrates maps of $O2_{c\text{-}ss}$ from k, T*, and rpm at from steady state. From an in-cylinder O2 estimation model or intake O2 sensor, the bias of O2 concentration at transient from steady state is calculated as:

$$\Delta O2_c=O2_{c\text{-}current}-O2_{c\text{-}ss}$$

Referring again to FIG. 10, an "uncorrected" injection timing parameter may be mapped to k, T*, and rpm. From $O2_{c\text{-}ss}$ and $\Delta O2_c$ at each engine speed, an injection timing correction factor, $\Delta\theta_{p,\,m,\,etc.}$, is determined by the following empirical function:

$$\Delta\theta_{p,\,m,\,etc.}=a(\Delta O2_c)^b$$

, with the qualification that if $\theta_{p,\,m,\,etc.}$>critical (such as may be limited by combustion chamber or nozzle geometry), θ=θ (max).

Figure 13:
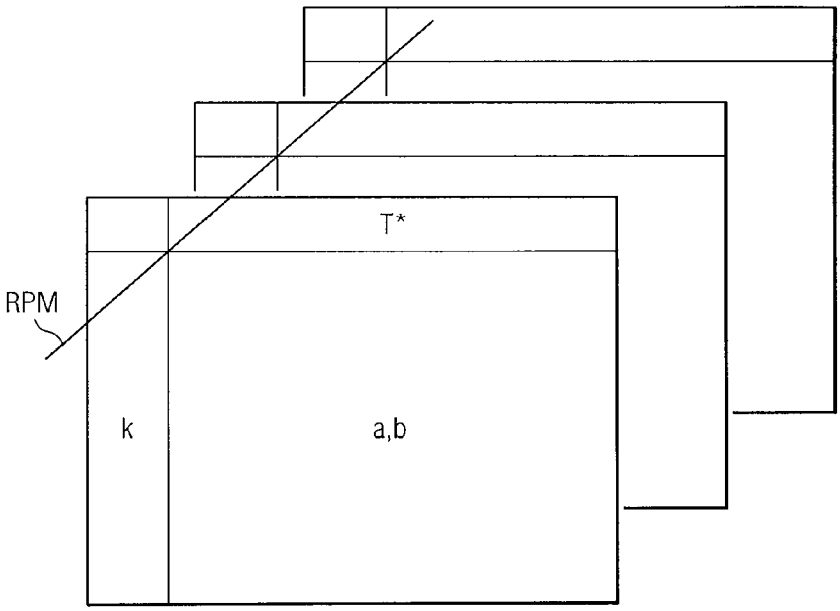
FIG. 13 illustrates Mode 2 tables that map torque representative values, temperature representative values, and engine speed values to values used in the representative oxygen mass calculation.

FIG. 13 illustrates how values for a and b are decided from k, T*, and rpm.

Using these maps and functions, a corrected injection timing value, $\theta_{p,\,m,\,etc.}$, is calculated as the sum of the "uncorrected" timing value and the correction factor.

$$\theta_{p,\,m,\,etc.}=\theta_{p\text{-}ss,\,m\text{-}ss,\,etc.\text{-}ss}+\Delta\theta_{p,\,m,\,etc.}$$

2.6 Combustion Control for Mode 2

Figure 14:
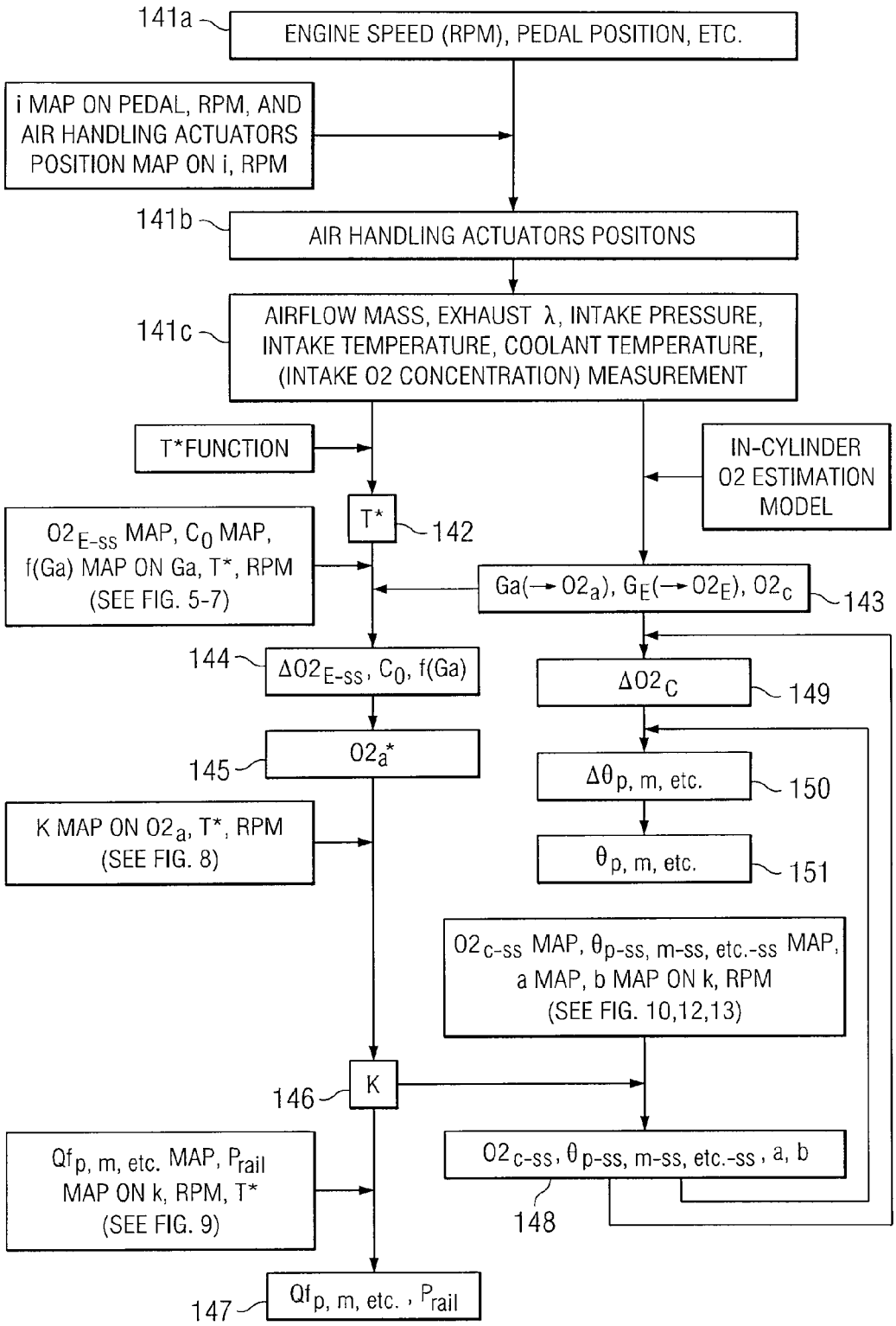
FIG. 14 illustrates the Mode 2 (lean combustion) control process.

FIG. 14 illustrates how the above-described tables and calculations are used to determine fueling control parameters.

In Step 141*a*, various input values are acquired by measurement or otherwise. These values include engine speed (rpm) and pedal position. Referring again to FIG. 1, the engine may include various sensors for obtaining these measurements, as well as other measured values discussed herein.

In Step 141*b*, values are determined for various air handling actuator positions. Air handling actuators include EGR, SCV, and VNT, and the like. In the example of FIG. 14, a first map is used to obtain an air handling representative value, i, from factors such as rpm and pedal position. Then a second map is used to obtain air handling position values from i and rpm.

In Step 141*c*, values are determined for airflow mass (Ga), exhaust oxygen concentration (λ), intake pressure, intake air temperature ($T_{in}$), and engine coolant temperature ($T_{cool}$).

In Step 142, as described above in Part 2.2, a temperature representative value, T*, is calculated from the coolant temperature and intake temperature.

In Step 143, as described above in Part 2.1, an in-cylinder estimation model is used to determine values of $O2_a$, $O2_e$ and $O2_c$. More specifically, the total in-cylinder gas flow (per cycle) is the total of the fresh air flow (Ga) and the EGR flow (Ge), which each have an O2 component, $O2_a$ and $O2_e$, respectively. The total in-cylinder oxygen, $O2_c$, is the total of $O2_a$ and $O2_e$. Various "in-cylinder O2 estimation" methods can be used to estimate $O2_c$, such as the methods described in U.S. Pat. No. 7,163,007, incorporated by reference herein.

In Step 144, as described above in connection with FIGS. 5-7, values of Ga, T*, and rpm are used to determine values of the deviation of O2 mass in EGR from steady state ($\Delta O2_{E\text{-}ss}$), the fresh air O2 ratio ($C_O$) and the air flow mass function (f(Ga)).

In Step 145, as described above, the values determined in Step 144 are used to determine a value for a "fake" or "representative" O2 mass in fresh air, $O2_a$*.

In Step 146, as described above in connection with FIG. 8, a torque representative value, k, is determined from $O2_a$*, T*, and rpm.

In Step 147, as described above in connection with FIG. 9, values for fuel injection quantity and pressure can be obtained from tables of k, T*, and rpm.

In Step 148, as described above in connection with FIGS. 10, 12, and 13, values for "base" fuel injection (or ignition) timing, oxygen concentration at steady state, and a and b values are obtained from tables.

In Step 149, the $O2_c$ value determined in Step 143 and the $O2_{c\text{-}ss}$ value from the table of FIG. 12 are used to calculate a value for an oxygen concentration bias, $\Delta O2_c$.

In Step 150, a timing correction factor, Δθ, is calculated from the $\Delta O2_c$ value determined in Step 149 and from the a and b values obtained in Step 148.

In Step 151, a "corrected" timing parameter is determined from the correction factor and the "base" timing parameter determined in Step 150 and from the table of FIG. 10.

2.7 Mode 0 to Mode 2 Switching

Figure 15:
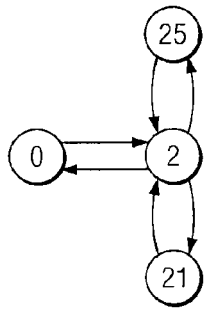
FIG. 15 illustrates how the process of FIG. 14 eliminates the need for a different Mode 1 control process.

As illustrated in FIG. 15 and referring again to FIGS. 2 and 3, using the control process of FIG. 14, Mode 1 is removed. Mode 0 and Mode 2 are connected directly.

The lean combustion control process may include normal operation mode (Mode 2), idle mode (Mode 0 with torque is controlled by engine speed), high acceleration mode (Mode 25 with bootstrapping), and high deceleration mode (Mode 21 with quick O2 reduction to avoid over run).

Figure 16:
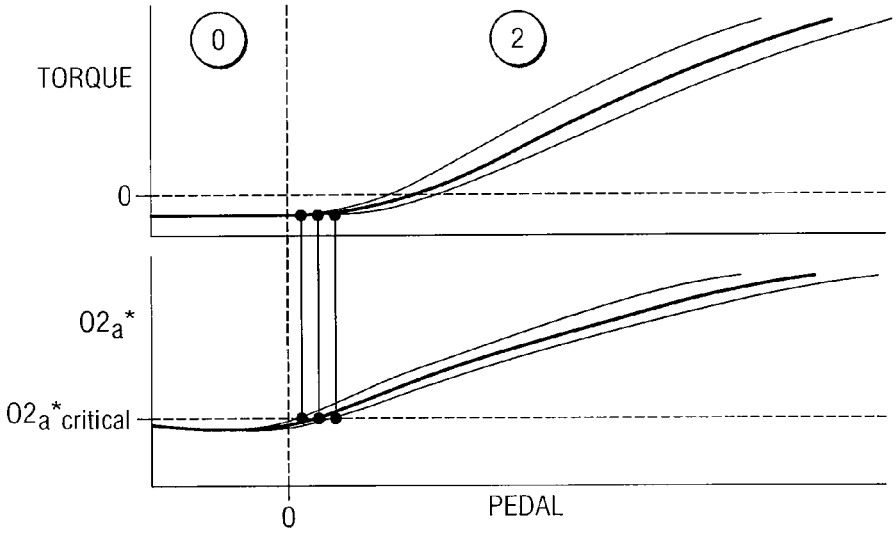
FIG. 16 illustrates how the representative oxygen mass value is gradually reduced for switching from Mode 0 to Mode 2.

FIG. 16 illustrates how O2a* is gradually reduced with reducing pedal position when switching from Mode 2 to Mode 0. In this case, the critical (fake) O2 mass of fresh air ($O2_a{}^*_{critical}$) is a little higher than the O2 of fresh air at steady state idling (pedal=0) condition. When the engine speed is high and its fuel is cut, fuel injection starts at $O2_a{}^*=O2_a{}^*_{critical}$, not at pedal on point. If $O2_a{}^*<O2_a{}^*_{critical}$ with pedal on, fuel is injected. The relation between pedal position and $O2_a$* can change, but permits the driver to operate the vehicle without the torque shock caused by control mode switching at pedal 0 areas.

3. Airflow-Based Control for Modes 3, 23, and 32

Mode 3 is rich operation. Modes 23 and 32 are switching operations from lean-to-rich and rich-to-lean, respectively.

Several basic control factors for these modes are k (the torque representative value), O2 (the in-cylinder O2 mass in lean operation), and i (a representative value of air-handling actuator positions). However, for Modes 3, 23, and 32, these basic control factors are qualified from those of Mode 2, as explained below.

In Mode 3, as in Mode 2, combustion control is airflow-based. The torque representative value is referred to as $k_R$, and is based on predicted in-cylinder conditions and engine speed. Then the values of $k_R$ and engine speed determine the combustion control parameters. Air-handling actuators are controlled by desired torque.

During Modes 23 and 32, combustion control is based on airflow and desired torque representative k (as affected by pedal position). The torque representative value is referred to as $k_{LR}$ or $k_{RL}$ (and collectively as $k_t$). Combustion control parameters are determined by $k_t$ and in-cylinder conditions, but k is allowed to change with changing desired torque. Air-handling actuators are controlled to achieve desired in-cylinder conditions such as desired in-cylinder O2 mass.

3.1 Key Factors (k, O2, and i) for Modes 3, 23, and 32

Control of fueling parameters during the transient periods (lean to rich or rich to lean) is explained using subscripts LR, RL, and t. The subscript "t" refers to both Modes 23 and 32.

Torque Representative

For Mode 23, the torque representative, $k_{LR}$, is decided from the previous torque representative value, differential of pedal position, and current engine speed. In Mode 3, $k_R$ is decided from in-cylinder conditions. In Mode 32, the torque representative, $k_{RL}$, is determined from the previous torque representative, differential of pedal position, and current engine speed.

O2 Mass $O2_R$ is the total in-cylinder O2 mass for rich operation in Modes 23, 3, and 32. The physical definition is the same as for $O2_{total}=O2_a^*/C_0$ in Mode 2.

Air Handling Representative

For Modes 3, 23, 32, an air handling representative value, $i_R$, is introduced. The value of $i_R$ is decided by engine speed and pedal position, and decides each air handling actuator's position.

Figure 17:
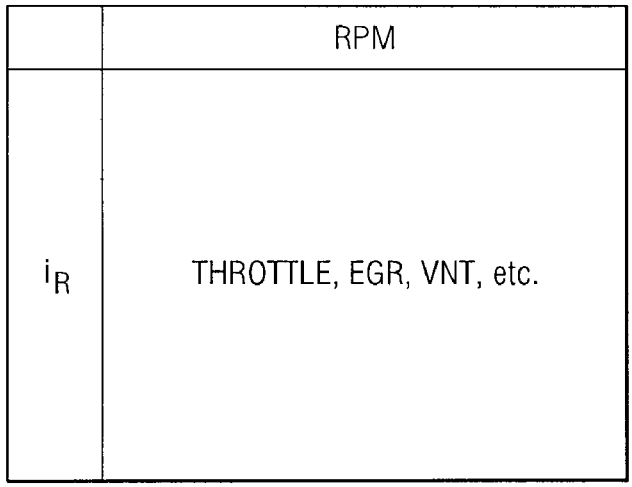
FIG. 17 illustrates Mode 3 tables that map air handling representative values and engine speed values to air handling position values.

FIG. 17 illustrates how $i_R$ and rpm are mapped to positions of various air-handling actuators. At steady state condition, $O2_R$ increases with increasing $i_R$. For overshooting in Mode 23, $i_R$ is reduced. It is increased in Mode 32.

3.2 Mode 3 Control Factors

Figure 18:
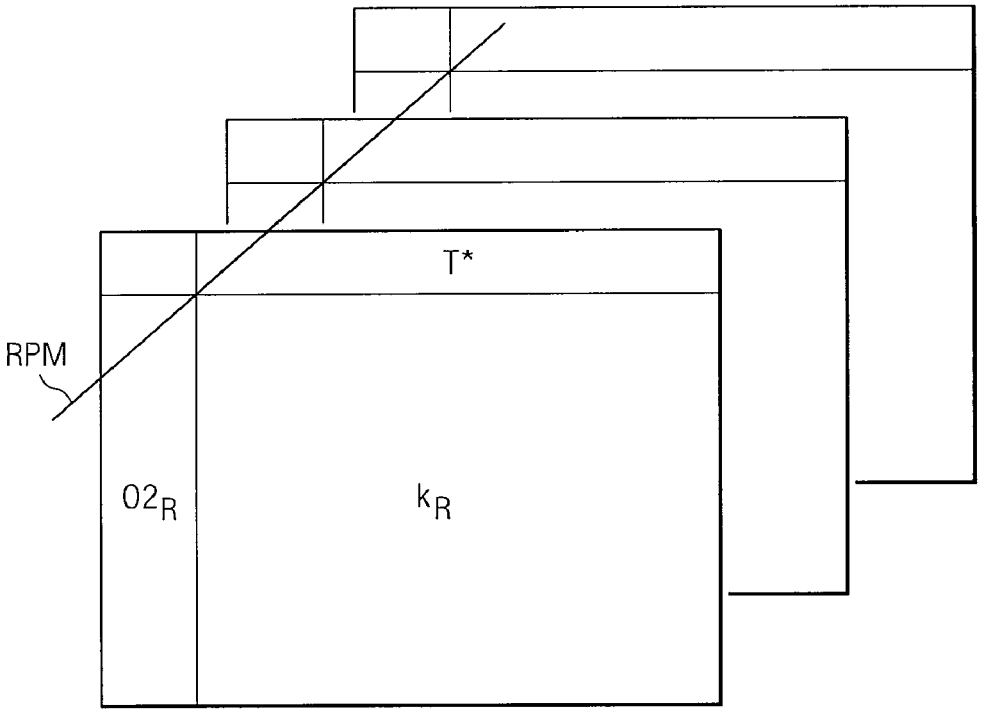
FIG. 18 illustrates Mode 3 tables that map in-cylinder oxygen mass values, temperature representative values, and engine speed values to torque representative values.

FIG. 18 illustrates steady state tables that map current engine speed, T* and $O2_R$ to values of $k_R$. The temperature representative T* is calculated in the same manner as described above for Mode 2. ($T^*=T_{cool}+f_T(T_{in}-T_{in\text{-}ss})$.

Figure 19:
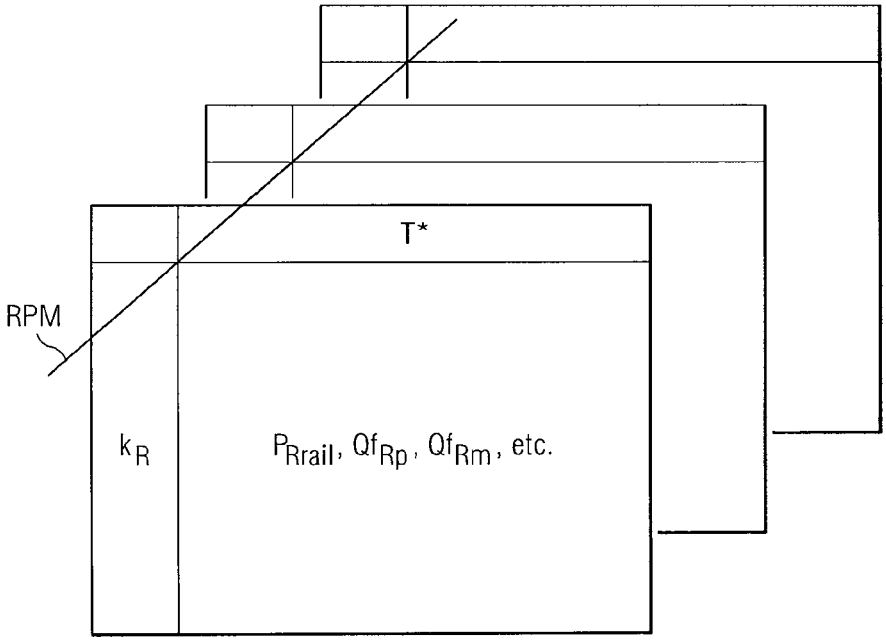
FIG. 19 illustrates Mode 3 tables that map torque representative values, temperature representative values, and engine speed values to various fueling parameter values.

FIG. 19 illustrates how various fueling parameters are determined from $k_R$, T*, and rpm.

Figure 20:
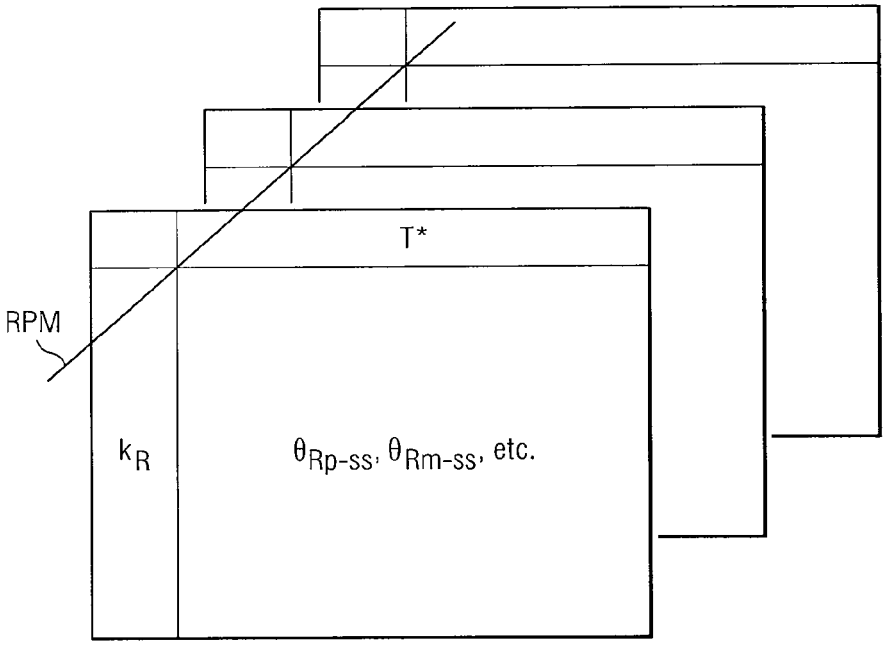
FIG. 20 illustrates Mode 3 tables that map torque representative values, temperature representative values, and engine speed values to combustion timing values.

FIG. 20 illustrates how injection timing before correction ($\theta_{R\text{-}ss}$) is also decided from rpm, T*, and $k_R$, using steady state mapping.

Figure 21:
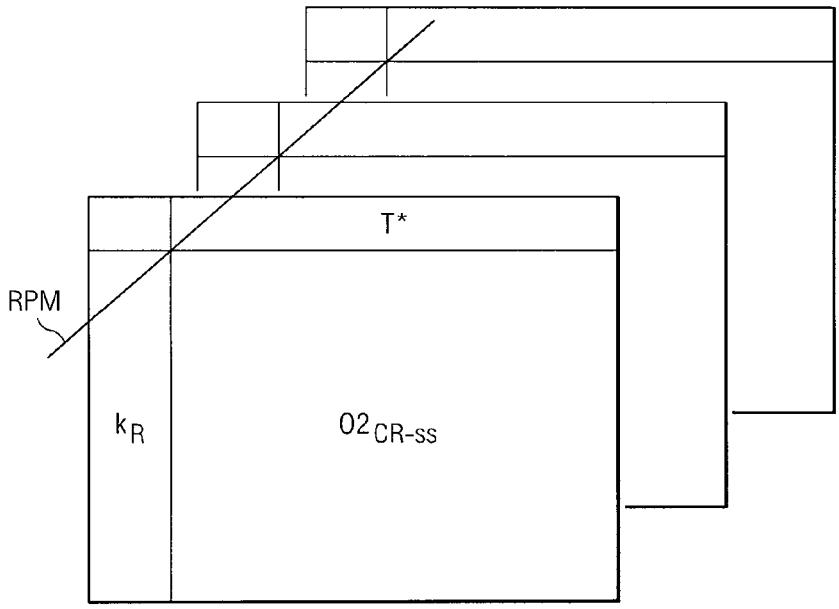
FIG. 21 illustrates Mode 3 tables that map torque representative values, temperature representative values, and engine speed values to the oxygen concentration at steady state for use in correcting the combustion timing values of FIG. 20.

FIG. 21 illustrates mapping of rpm and $k_R$ to O2 concentration at steady state test ($O2_{CR\text{-}ss}$) for the use in correction of injection timing.

As in Mode 2, Mode 3 injection timing is corrected by O2 concentration ($O2_{CR}$). The relation between $O2_{CR}$ and optimal injection timing is similar to that of FIG. 11, with the substitution of $O2_{CR}$ for $O2_C$. An injection timing correction factor for Mode 3 ($\Delta\theta_{RP,\,Rm,\,etc.}$) is decided with an empirical function:

$$\Delta\theta_{Rp,\,Rm,\,etc.}=a_R\cdot(\Delta O2_{CR})^{b_R}$$

In a manner similar to FIG. 13, parameters $a_R$ and $b_R$ are decided from $k_R$, T* and rpm for each injection (pilot, main, etc.). If $\theta_{Rp,\,Rm,\,etc.}$>critical as limited by constraints such as the combustion chamber or nozzle geometry), $\theta_R=\theta_R(\text{Max})$. Using these maps and functions, injection timing ($\theta_{p,\,m,\,etc.}$) is corrected to compensate for the bias of O2 concentration at each $k_R$, T* and rpm.

3.3 Modes 23 and 32; Relation Between $k_t$, $O2_R$ and T*

Figure 22:
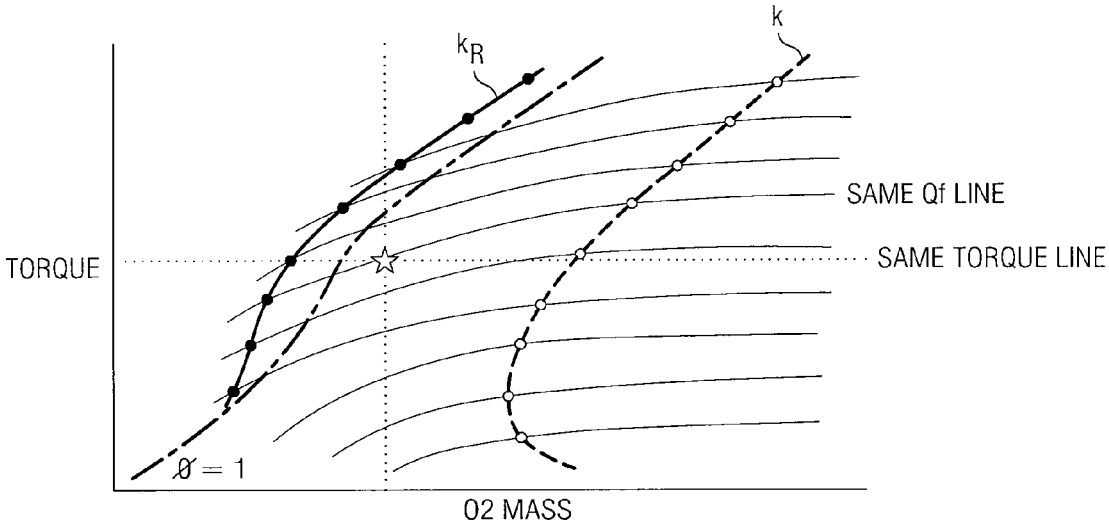
FIG. 22 compares, for Modes 2 and 3, the curves of torque representative values for varying values of oxygen mass and torque.

FIG. 22 illustrates the relationship between O2 mass, k (torque representative), and fuel injection mass. The solid curve is the relation between current O2 mass and the torque representative $k_R$ of rich operation at current T*. The dashed curve is the relation between current O2 mass and torque representative k of lean operation at current T*. These two curves can be plotted from the tables described above, from current temperature representative T*, and from engine speed.

Before fuel injection, a desired k is predicted from the previous k value, pedal differential, and engine speed, desired "k" is predicted (dotted horizontal line). From current O2 mass and T*, a desired point (star point) can be defined. The near-horizontal curves indicate the same fuel injection mass.

To determine fuel injection mass ($Qf_p$, $Qf_m$, etc.), an empirical function is introduced with or without a mid O2 concentration map. The following functions can be applied to both Mode 23 and Mode 32, as indicated by the subscript "t".

$$Qf_{pt}=Qf_{pt}(Qf_p,\ Qf_{Rp},\ O2)$$

$$Qf_{mt}=Qf_{mt}(Qf_m,\ Qf_{Rm},\ O2)$$

$$P_{railt}=P_{railt}(P_{rail},\ P_{Rrail},\ O2)$$

Injection timing before correction is also defined by empirical functions.

$$\theta_{p\text{-}sst}=\theta_{p\text{-}sst}(\theta_{p\text{-}ss},\ \theta_{Rp\text{-}ss},\ O2_C)$$

$$\theta_{m\text{-}sst}=\theta_{m\text{-}sst}(\theta_{m\text{-}ss},\ \theta_{Rm\text{-}ss},\ O2_C)$$

The correcting factor, $\Delta\theta$, is decided from empirical functions of $a_t$ and $b_t$. Values of $a_t$ and $b_t$ can be interpolated from a, b and $a_R$, $b_R$ proportionally.

$$a_{pt}=a_{pt}(a_p,\ a_{pR},\ O2_C)$$

$$a_{mt}=a_{mt}(a_m,\ a_{mR},\ O2_C)$$

$$b_{pt}=b_{pt}(b_p,\ b_{pR},\ O2_C)$$

$$b_{mt}=b_{mt}(b_m,\ b_{mR},\ O2_C)$$

Fuel injection timing is decided as:

$$\theta_{pt}=\theta_{p\text{-}sst}+\theta_{p\text{-}sst},=\theta_{p\text{-}sst},+a_{pt}\cdot(\Delta O2_C)^{b_{pt}}$$

$$\theta_{mt}=\theta_{m\text{-}sst}+\Delta\theta_{m\text{-}sst},=\theta_{m\text{-}sst},+a_{mt}\cdot(\Delta O2_C)^{b_{mt}}$$

3.4 Switching Control for Modes 3, 23, and 32

Figure 23:
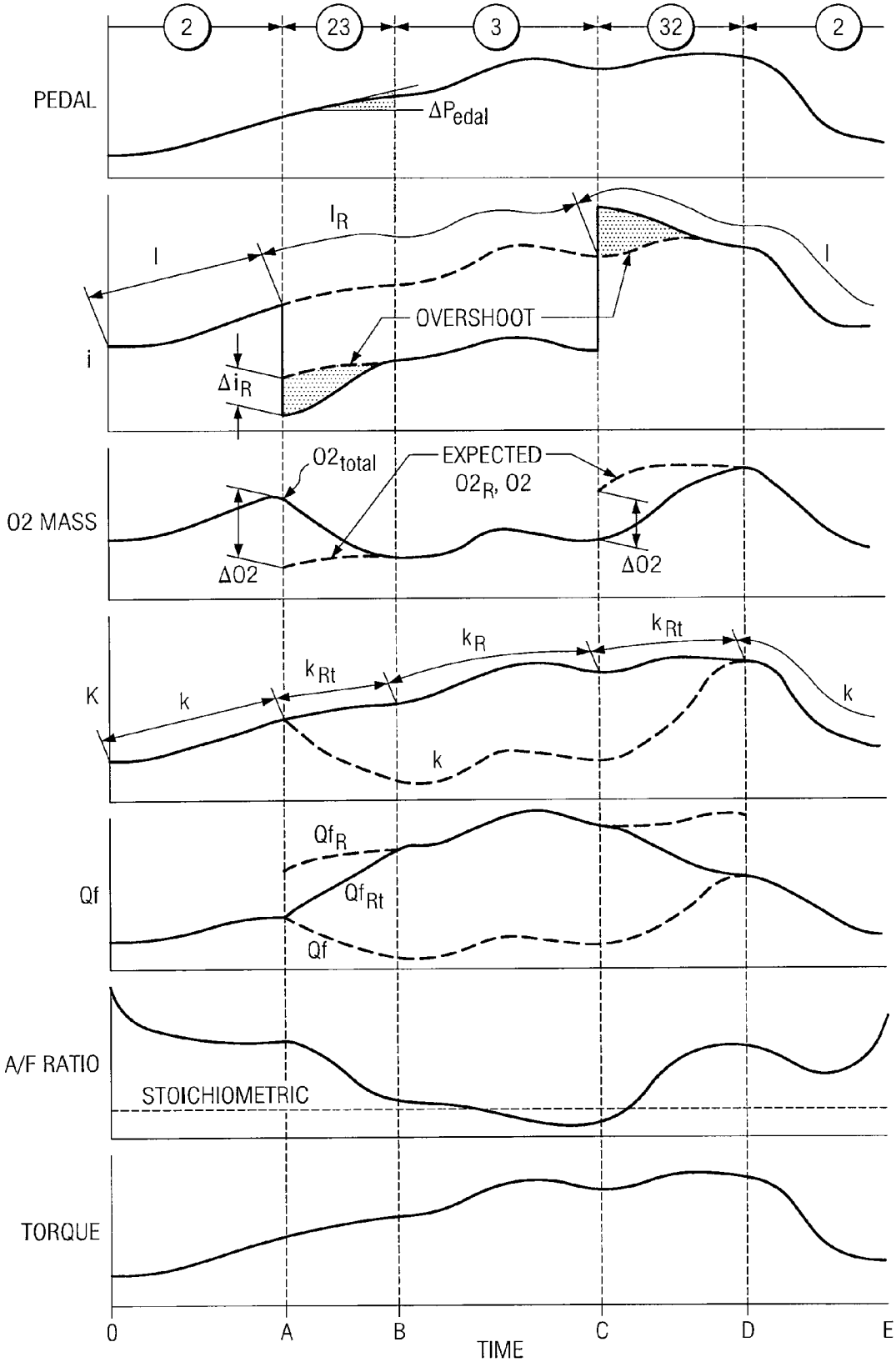
FIG. 23 illustrates mode timing for values of pedal position, air handling representative, oxygen mass, torque representative, fuel quantity, A/F ratio, and torque.

FIG. 23 illustrates mode timing. From the start (time=0) to point A, the engine is operated in Mode 2 (normal lean operation). Mode 23 (lean to rich transient) is from point A to point B. Mode 3 (rich operation) is from point B to point C. Mode 32 (rich to lean transient) is from point C to point D. Mode 2 is from point D to end.

At point A (at the end of Mode 2), the O2 mass in cylinder ($O2_{total}$) was calculated from Mode 2 logic ($O2_a^*\rightarrow O2_{total}$). The torque representative, k, is decided from $O2_a^*$ in Mode 2.

In Mode 23 (lean to rich transient), the desired torque representative is decided from the previous value, engine speed, and differential of pedal position ($\Delta P_{edal}$). In other words, $$k_{LR}=k_{LR}+\Delta k_{LR}(\Delta P_{edal})$$

Figure 24:
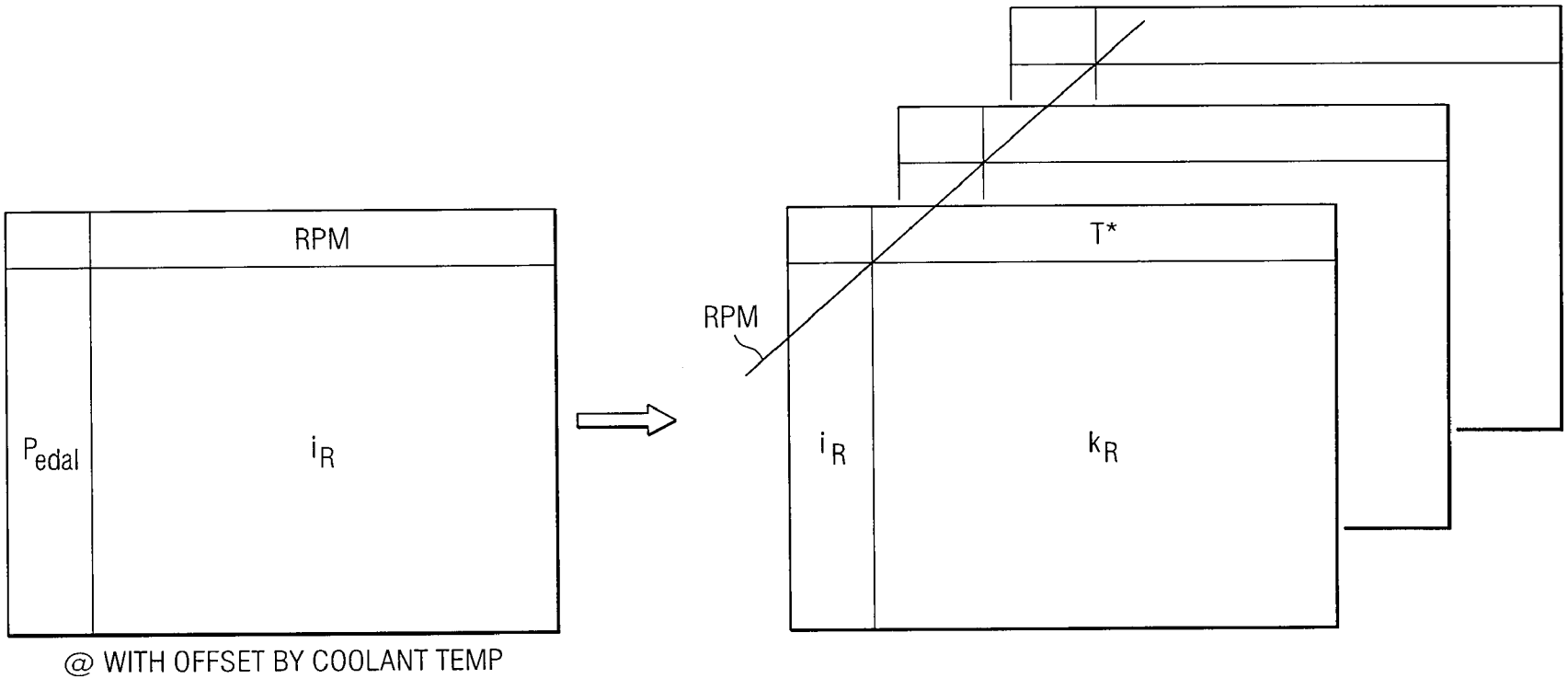
FIG. 24 illustrates Mode 23 tables that map engine speed values and pedal position values to air handling representative values, which are then mapped to torque representative values.

FIG. 24 is a steady state rich map of the relation between $\Delta P_{edal}$ and $\Delta k_{LR}$. Referring again to FIG. 23, in Modes 23, 3, and 32, the desired torque representative value is bigger than the k calculated from Mode 2 logic (dotted line).

Figure 25:
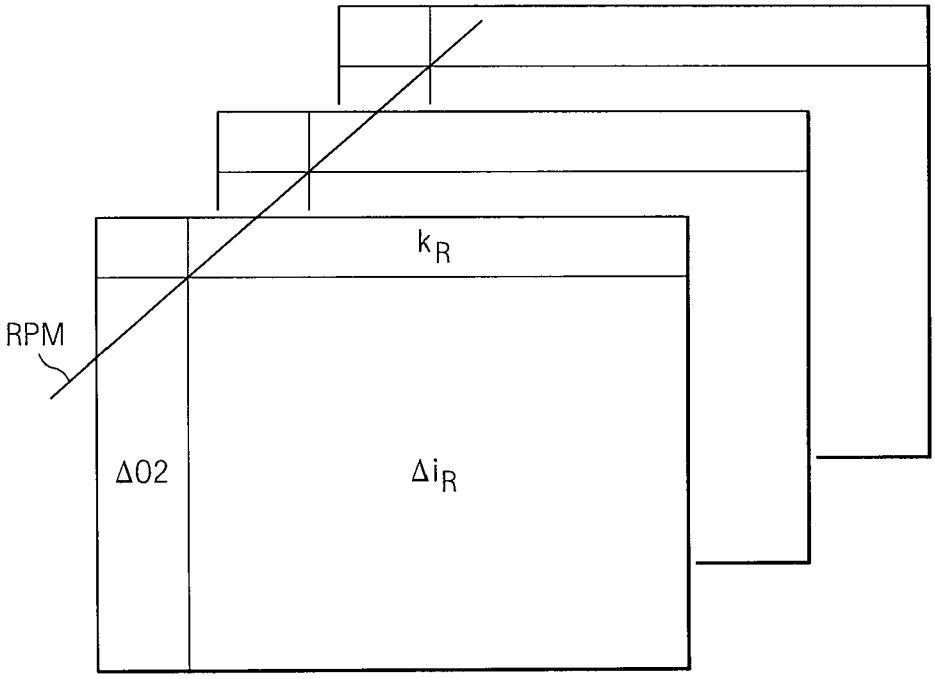
FIG. 25 illustrates Mode 23 tables that map oxygen difference values, torque representative values, temperature representative values, and engine speed values to air handling representative overshooting values.

The value of $i_{LR}$ is decided from current pedal position and engine speed plus an overshooting value $\Delta i_R(\rightarrow i_{LR}=i_{LR}+\Delta i_R)$. As illustrated in FIG. 25, the overshooting value for $\Delta i_R$ is decided from k ($k_R$), ΔO2(current O2−expected $O2_R$), and engine speed.

Figure 26:
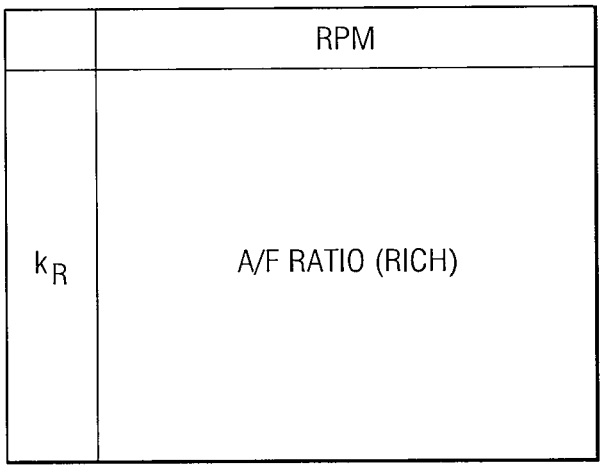
FIG. 26 illustrates Mode 23 tables that map torque representative values and engine speed values to A/F ratio values.

As illustrated in FIG. 26, the expected $O2_R$ is calculated from a desired A/F ratio map (rich) on $k_R$ and rpm.

From measured current O2 mass and T*, fuel quantity is calculated from empirical functions described above in Part 3.3. From O2 concentration, injection timing is corrected with empirical functions as described above.

Figure 27:
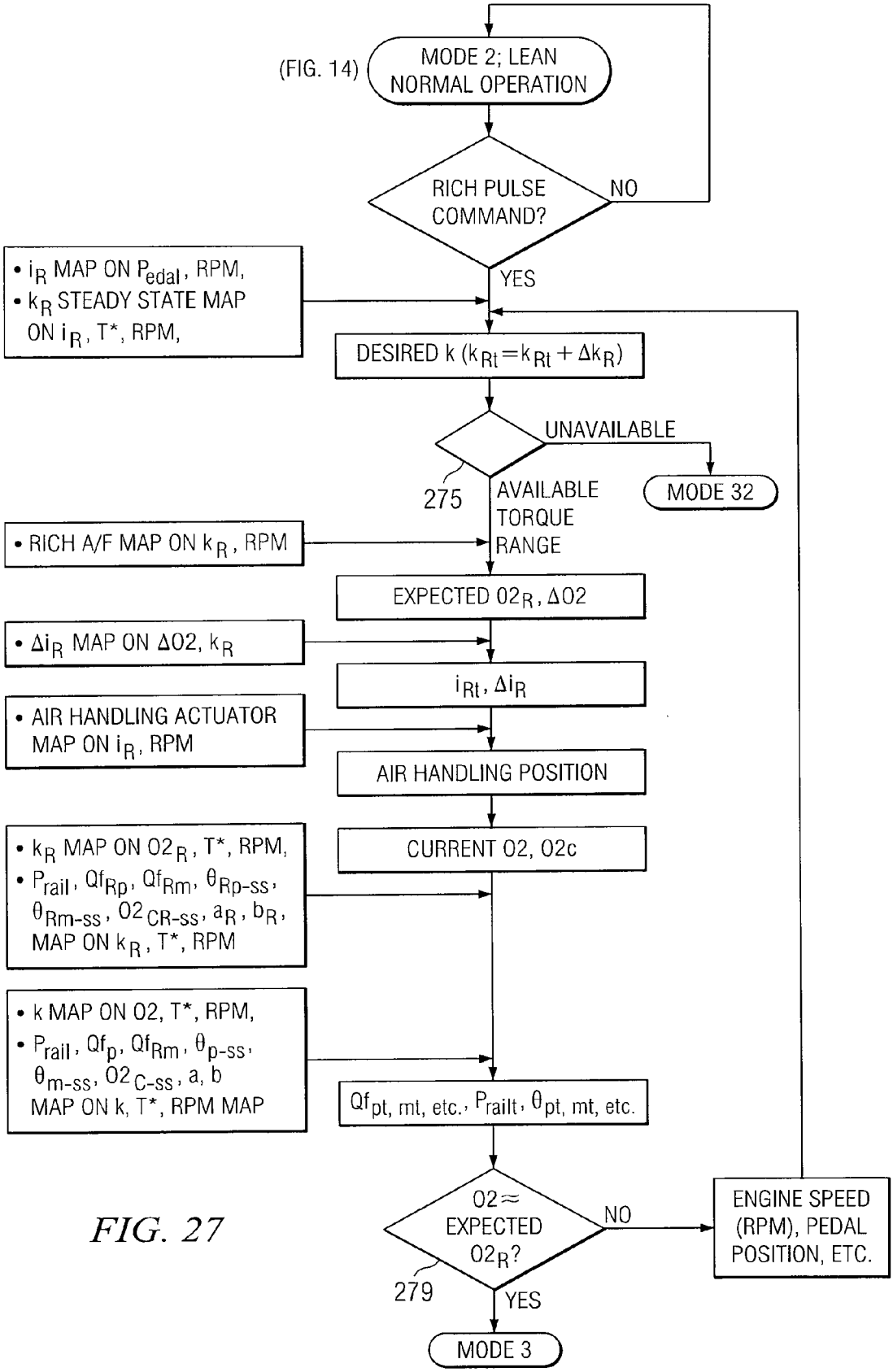
FIG. 27 illustrates the control process for Mode 23.
Figure 28:
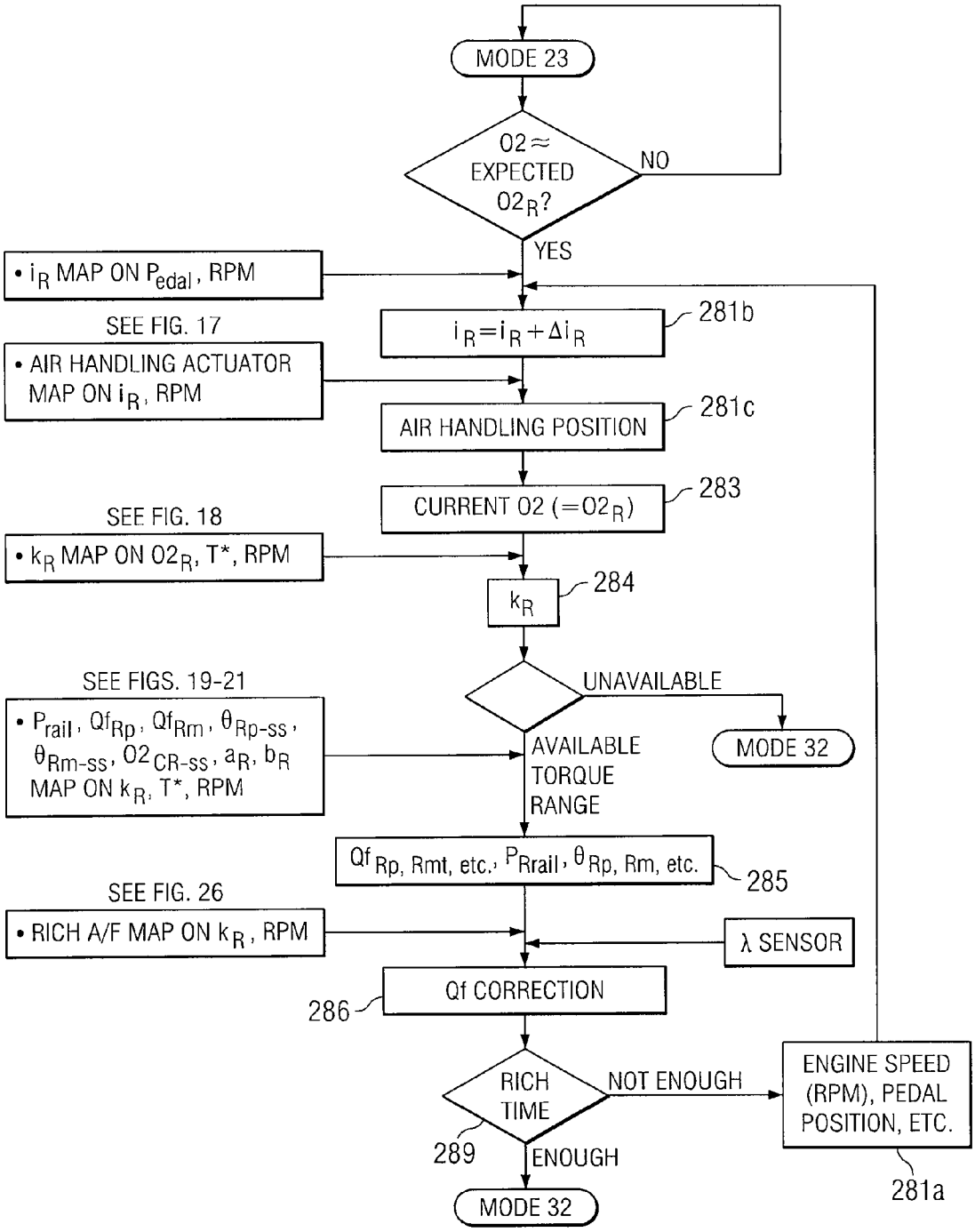
FIG. 28 illustrates the control process for Mode 3.
Figure 29:
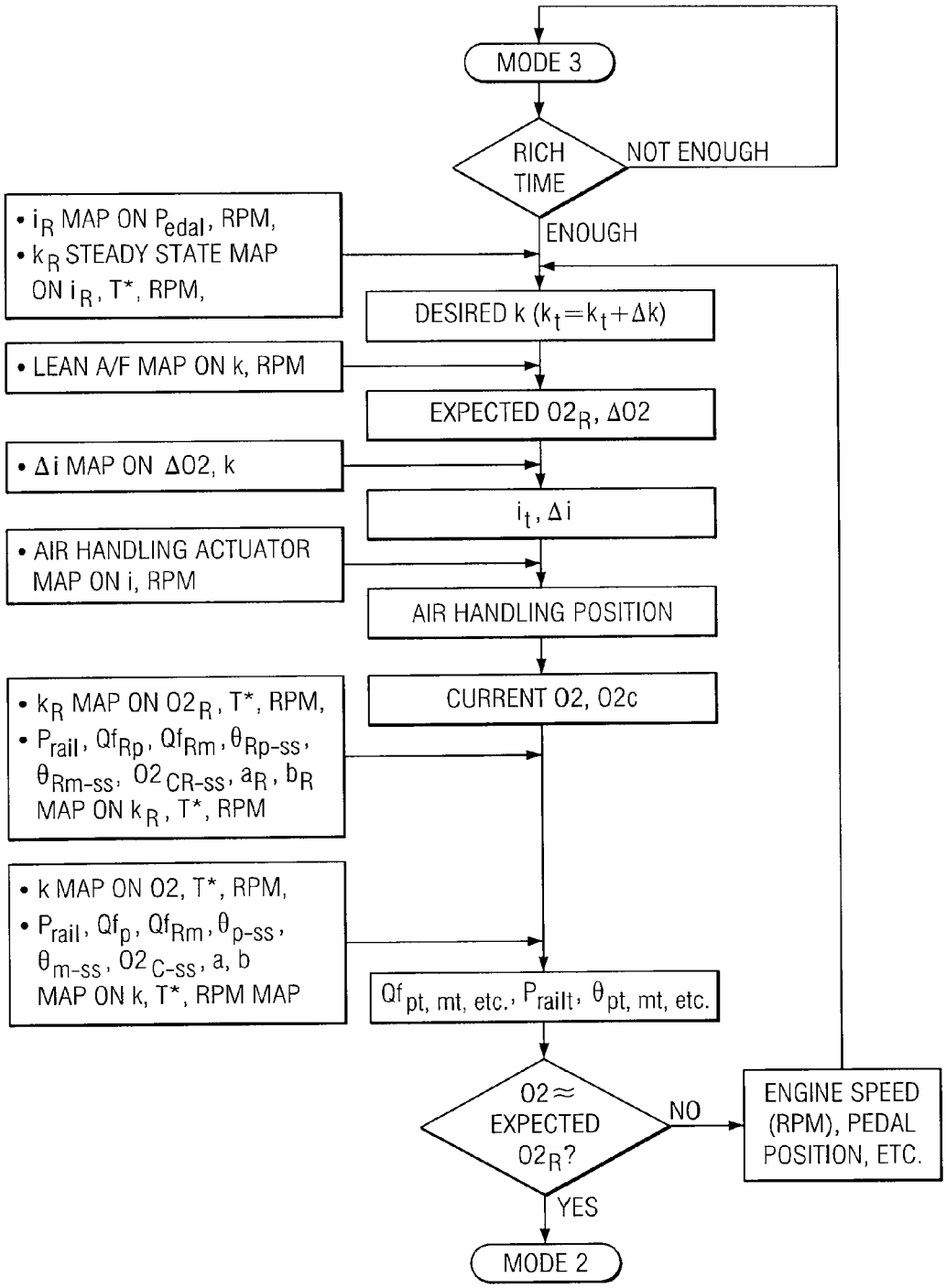
FIG. 29 illustrates the control process for Mode 32.

FIGS. 27, 28, and 29 are flowcharts for Modes 23, Mode 3, and Mode 32, respectively. Many of the steps are analogous to those of Mode 2 discussed above in connection with FIG. 14.

As illustrated in FIG. 27, Mode 23 starts in response to a rich pulse command. When the control mode is switched from lean to rich (Mode 23), the torque representative (representative of desired torque) and the desired in-cylinder O2 mass for rich combustion ($O2_R$) are decided from the previous (one cycle before) torque representative, the differential of pedal position (Δpedal), and current engine speed. Air handling actuators are controlled to reach the targeted in-cylinder O2 mass ($O2_R$) corresponding with the O2 mass of the targeted torque representative of Mode 3. When the difference between current and targeted O2 mass is big, air handling actuator positions are changed strongly with overshooting. When the difference becomes smaller, the change of air handling actuator positions becomes smaller. The torque representative is decided to adjust to the targeted torque at the current O2 mass. Fueling parameters and ignition timing are optimized to adjust to the in-cylinder condition (O2 mass, O2 concentration, and temperature representative).

The steps of FIG. 27 are referenced to the maps and steps described above in connection with FIGS. 24-26. In Step 275, if the desired torque in not available at rich combustion, the control mode is changed to Mode 32. In Step 279, if in-cylinder O2 becomes close to expected $O2_R$ (rich air fuel ratio), control mode is changed to Mode 3.

Referring to both FIGS. 23 and 27, Mode 3 (rich operation) begins at Point B, as decided by O2 mass. In Step 279, it is determined whether the O2 mass has arrived at the expected $O2_R$ for the desired torque. If so, Mode 3 begins.

FIG. 28 is a flowchart of Mode 3 control. In Step 281*a*, measurements for rpm and pedal position are obtained.

In Step 281*b*, the air handling representative value $i_R$ is decided from previous $i_R$ and the differential of pedal position. In other words, $i_R=i_R+\Delta i_R(\Delta pedal_I)$. The value of $\Delta i_R$ is decided from a map like that of FIG. 25.

In Step 281*c*, tables are used to obtain air handling position values from $i_R$ and rpm.

As indicated by Steps 283 and 284, the torque representative value for Mode 3, $k_R$, is controlled by O2. The logic is the same as for Mode 2 but specified for rich operation. FIG. 18 and its accompanying description provides further detail.

In Step 285, fueling parameters are determined as described above. In Step 286, the fuel injection quantity is offset to obtain a desired air fuel ratio (using λ sensor feedback and a desired A/F ratio map such as that of FIG. 26). FIGS. 19-21 and their accompanying description provide further detail.

In Step 289, once the exhaust oxygen, λ, arrives at the target value, the control mode is changed to Mode 32. There may be some delay (from 0 to four seconds).

FIG. 29 is a flowchart of Mode 32 control. In Mode 32 (rich to lean transient), the desired torque representative is decided from the previous torque representative value, engine speed, and the differential of pedal position ($\Delta P_{edal}$). In other words, $k_{RL}=k_{RL}+\Delta k(\Delta P_{edal})$.

Figure 30:
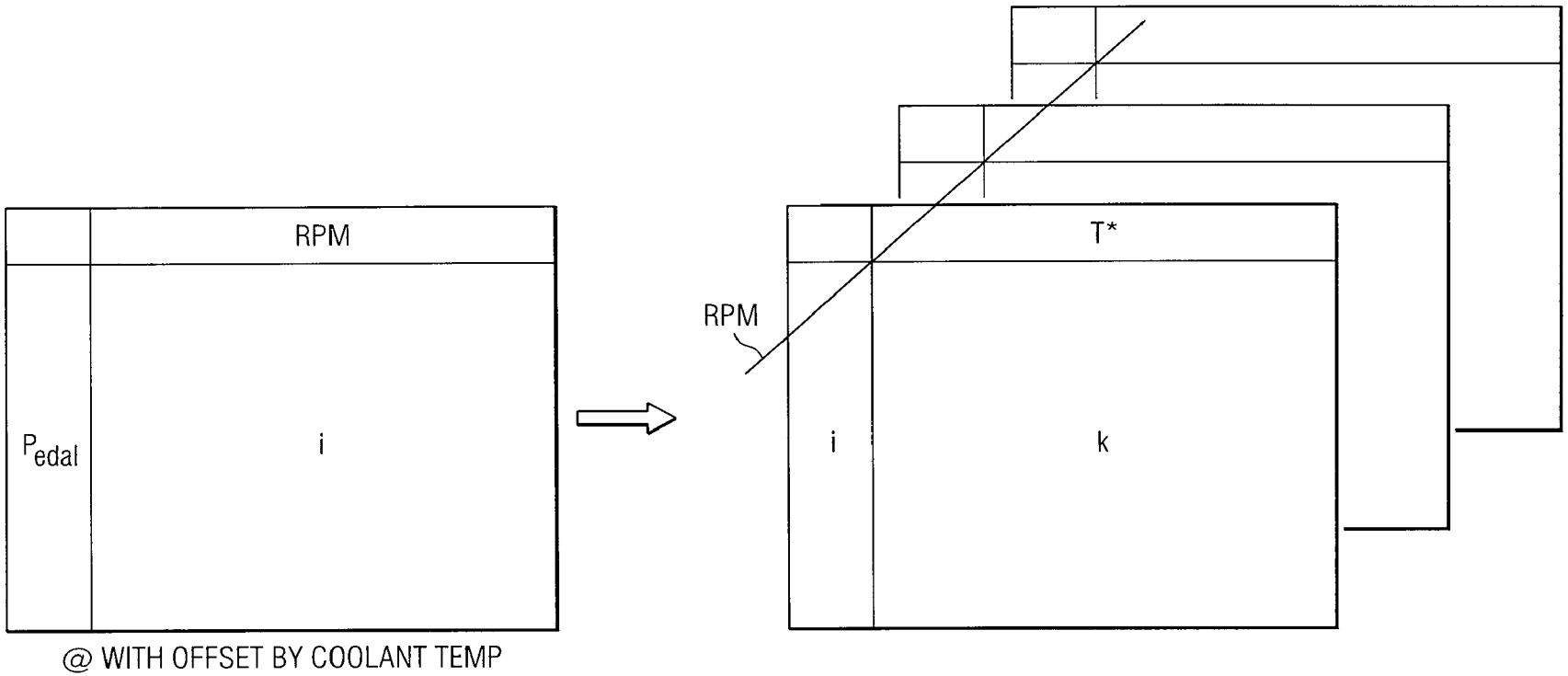
FIG. 30 illustrates Mode 32 tables that map engine speed values and pedal position values to air handling representative values, which are then mapped to torque representative values.

FIG. 30 is a steady state lean map, used to determine the relation between ΔPedal and Δk. Referring again to FIG. 23, $k_{RL}$ is bigger than the k calculated at Mode 2 (dotted line).

The value of $i_t$ is decided from current pedal position and engine speed on the lean operation map plus an overshooting value Δi. In other words, $i_t=i_t+\Delta i$.

Figure 31:
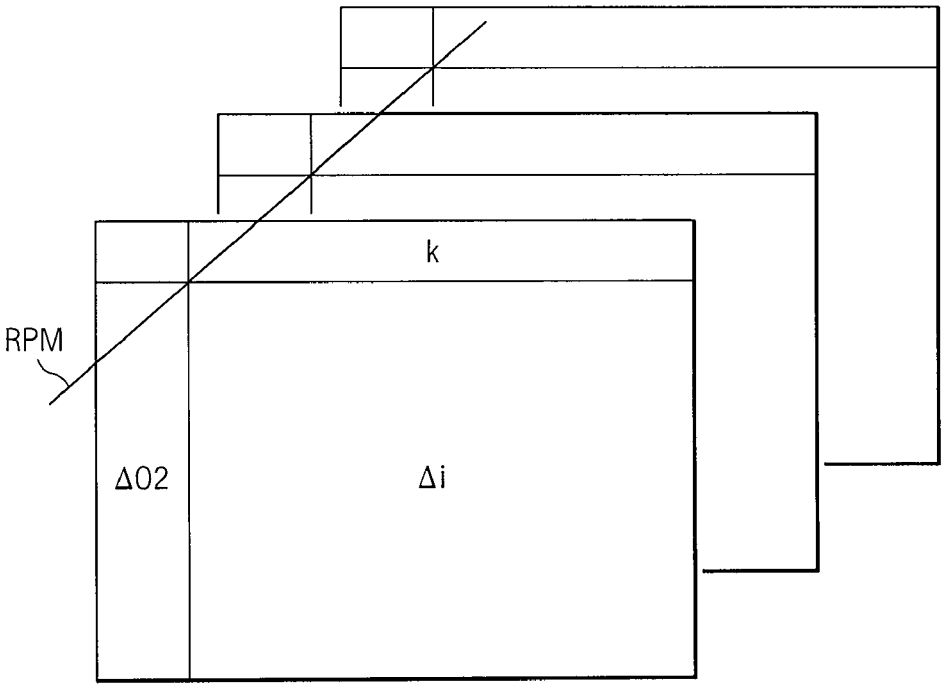
FIG. 31 illustrates Mode 32 tables that map oxygen difference values, torque representative values, and engine speed values to air handling representative overshooting values.

As illustrated in FIG. 31, the value of Δi is decided from $k_{RL}$, ΔO2 (current O2−expected O2) and engine speed. When the torque representative of Mode 32 is much bigger than that of Mode 2, overshooting of air handling actuators is used, and if the difference is small, overshooting is not used. The overshooting value is reduced to zero before the end of Mode 32.

Figure 32:
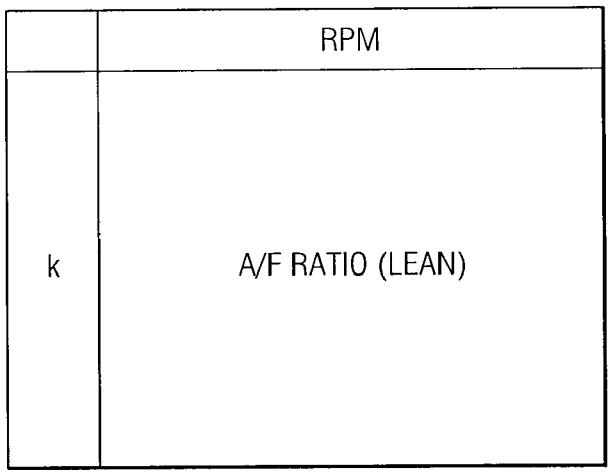
FIG. 32 illustrates Mode 32 tables that map torque representative values and engine speed values to A/F ratio values.

As illustrated in FIG. 32, the expected O2 is calculated by mapping k and rpm to desired A/F ratio map (lean).

From measured current O2 mass and T*, fuel quantity is calculated from empirical functions. From O2 concentration, injection timing is corrected with empirical functions as explained above in Part 3.3.

When the current O2 mass arrives as expected at point D, the control mode is changed to Mode 2.

What is claimed is:

1. A method of controlling combustion of an internal combustion engine during a lean mode of the engine, comprising:

storing, in a control unit, at least one combustion control table that defines at least one combustion control value in terms of the following variables: engine speed, representative temperature value, and representative torque;

during operation of the engine, receiving values representing engine speed, temperature, and intake air flow;

calculating a representative in-cylinder fresh air oxygen value and a representative temperature value;

wherein the representative in-cylinder fresh air oxygen value is calculated at least in part from the measured intake air flow;

using the representative in-cylinder fresh air oxygen value, the representative temperature value, and the engine speed value to calculate the representative torque value;

accessing the combustion control table, such that the representative torque value, the representative temperature value, and the engine speed value are used to determine at least one combustion control value; and using the combustion control value from the previous step to control an associated combustion control mechanism.

2. The method of claim 1, further comprising the steps of determining at least one air handling representative value and of using the air handling representative value to determine at least one air handling actuator position value, prior to the step of calculating the representative in-cylinder fresh air oxygen value.

3. The method of claim 1, wherein the temperature representative value is calculated from intake temperature and coolant temperature.

4. The method of claim 1, wherein the in-cylinder fresh air oxygen representative value is calculated from an estimated value of in-cylinder oxygen from fresh air added to the product of a fresh air flow weighting function, the ratio of in-cylinder oxygen in fresh air to total in-cylinder oxygen, and the deviation of oxygen mass in recirculated exhaust gas from steady state.

5. The method of claim 4, wherein the weighting function varies from 0 to 1 and varies during light load conditions of the engine.

6. The method of claim 4, wherein the weighting function is determined by storing and accessing a table of air flow, temperature, and engine speed values mapped to weighting function values.

7. The method of claim 4, wherein the ratio of in-cylinder oxygen from fresh air to total in-cylinder oxygen is determined by storing and accessing a table of air flow, temperature, and engine speed values mapped to values of the ratio.

8. The method of claim 4, wherein the deviation of oxygen mass in recirculated exhaust gas from steady state is determined by storing and accessing a table of air flow, temperature, and engine speed values mapped to values of the deviation.

9. The method of claim 1, wherein the at least one fueling parameter is fuel injection quantity.

10. The method of claim 1, wherein the at least one fueling parameter is rail pressure.

11. The method of claim 1, wherein the at least one fueling parameter is injection or ignition timing, and further comprising the step of correcting a base timing parameter with an O2 concentration correction factor.

12. The method of claim 11, wherein the correction factor advances timing when oxygen concentration is lower than at steady state.

13. A method of controlling combustion of an internal combustion engine during a rich mode of the engine, comprising:

storing, in a fueling control unit, a fueling quantity control table that defines fueling quantity control values in terms of the following variables: engine speed, representative temperature, and representative torque;

during operation of the engine, receiving values representing engine speed, temperature, and intake air flow;

calculating a representative in-cylinder total oxygen value and a representative temperature value;

wherein the representative in-cylinder total oxygen value is calculated at least in part from the intake air flow;

using the representative in-cylinder fresh air oxygen value, the representative temperature value, and the engine speed value to calculate the representative torque value;

accessing the fueling quantity control table, such that the representative torque value, the representative temperature value, and the engine speed value are used to determine a fueling quantity control value;

correcting the fueling quantity control value based on a desired air-fuel ratio and feedback from an exhaust oxygen sensor; and using the fueling quantity control value from the previous step to control fuel injection.

14. The method of claim 13, further comprising the steps of storing additional fueling parameter base maps for additional fueling parameters, and wherein accessing step is performed to obtain additional fueling control values.

15. The method of claim 13, further comprising the initial step of beginning the rich mode when the oxygen concentration reaches a rich mode oxygen concentration.

16. The method of claim 13, further comprising the steps of determining at least one air handling representative value and of using the air handling representative value to determine at least one air handling actuator position value, prior to the step of calculating the representative in-cylinder total oxygen value.

17. The method of claim 16, wherein the air handling representative value is determined from a current air handling representative value and a differential of pedal position.

* * * * *